US009080297B2

(12) United States Patent
Hanson

(10) Patent No.: US 9,080,297 B2
(45) Date of Patent: Jul. 14, 2015

(54) IMPLEMENT WITH LINKAGE ASSEMBLY AND WORK ASSEMBLY WHEREIN WORK ASSEMBLY HAS DYNAMIC SKID SHOE AND A SCRAPING EDGE

(71) Applicant: Glenridge, Inc., Glenwood, MN (US)

(72) Inventor: Grant Hanson, Glenwood, MN (US)

(73) Assignee: Glenridge, Inc., Glenwood, MN (US)

( * ) Notice: Subject to any disclaimer, the term of this patent is extended or adjusted under 35 U.S.C. 154(b) by 0 days.

(21) Appl. No.: 14/259,712

(22) Filed: Apr. 23, 2014

(65) Prior Publication Data

US 2014/0230288 A1 Aug. 21, 2014

Related U.S. Application Data

(60) Division of application No. 13/285,720, filed on Oct. 31, 2011, now Pat. No. 8,732,988, which is a continuation-in-part of application No. 12/085,537, which is a continuation of application No. 11/291,258, filed as application No. PCT/US2006/045668 on Nov. 30, 2006, now Pat. No. 8,046,939.

(51) Int. Cl.

| | |
|---|---|
| ***E01H 5/04*** | (2006.01) |
| ***E01H 5/06*** | (2006.01) |
| ***E01H 5/07*** | (2006.01) |
| ***E02F 3/36*** | (2006.01) |
| ***E02F 3/40*** | (2006.01) |

(Continued)

(52) U.S. Cl.

CPC ..... *E01H 5/062* (2013.01); *E01H 5/066* (2013.01); *E01H 5/076* (2013.01); *E01H 5/08* (2013.01); *E02F 3/3604* (2013.01); *E02F 3/401* (2013.01); *E02F 3/422* (2013.01); *E02F 3/432* (2013.01); *E02F 9/226* (2013.01)

(58) Field of Classification Search

USPC ..... 37/231, 232, 241–244, 274, 281, 266, 37/221, 223, 245; 172/2–11, 722, 172/810–823, 393; 280/28, 28.17

See application file for complete search history.

(56) References Cited

U.S. PATENT DOCUMENTS 1,744,801 A 1/1930 Rimple et al.
1,833,859 A 11/1931 Robison et al.

(Continued)

FOREIGN PATENT DOCUMENTS

WO 91/09177 6/1991

OTHER PUBLICATIONS

Tim Wallace Snowplow Supply, Hiniker Plows, "Move More Snow Faster—Hiniker 8000 Series Convertible C-Plow", 2003.

*Primary Examiner* — Robert Pezzuto

(74) *Attorney, Agent, or Firm* — Hamre, Schumann, Mueller & Larson, P.C.

(57) ABSTRACT

An implement including a work assembly for clearing materials on a ground, the work assembly including an edge and at least one dynamic skid shoe. The implement may have a pair of dynamic skid shoes. The dynamic skid shoe includes a surface contact component for contacting a street surface, a dynamic component operably connected to the surface contact component for providing vertical movement of the surface contact component, and a hydraulic fluid circuit including a pressure providing component fluidily connected to the dynamic component. The implement includes a linkage assembly, wherein the linkage assembly and the dynamic skid shoe operate to provide the edge to be elevated above the ground surface in order to pass over an obstruction encountered by the edge even on uneven surfaces.

10 Claims, 25 Drawing Sheets

(51) Int. Cl.

| | |
|---|---|
| ***E02F 3/42*** | (2006.01) |
| ***E02F 3/43*** | (2006.01) |
| ***E02F 9/22*** | (2006.01) |
| ***E01H 5/08*** | (2006.01) |

(56) References Cited

U.S. PATENT DOCUMENTS

| | | | |
|---|---|---|---|
| 2,166,424 | A | 7/1939 | Coates |
| 2,629,944 | A | 2/1953 | Arps |
| 2,643,470 | A | 6/1953 | Kaeser |
| 2,697,289 | A | 12/1954 | Ernest |
| 2,700,233 | A | 1/1955 | Johnson et al. |
| 2,745,328 | A | 5/1956 | Brimhall |
| 2,756,522 | A | 7/1956 | Bomford |
| 2,862,315 | A | 12/1958 | Hilaire |
| 2,890,805 | A | 6/1959 | Pilch |
| 3,005,511 | A | 10/1961 | Riedy |
| 3,098,309 | A | 7/1963 | Koch |
| 3,151,406 | A | 10/1964 | Fryer |
| 3,231,991 | A | 2/1966 | Wandscheer et al. |
| 3,456,369 | A | 7/1969 | Leposky |
| 3,587,182 | A | 6/1971 | Hilt |
| 3,587,751 | A | 6/1971 | Schmidt, Jr. |
| 3,626,614 | A | 12/1971 | Kahlbacher |
| 3,650,054 | A | 3/1972 | Hanson |
| 3,749,269 | A | 7/1973 | Conrad |
| 3,808,714 | A | 5/1974 | Reissinger et al. |
| 3,845,577 | A | 11/1974 | Naymik |
| 3,883,965 | A | 5/1975 | Poirier |
| 4,141,257 | A | 2/1979 | Hammond et al. |
| 4,307,523 | A | 12/1981 | Reissinger et al. |
| 4,635,387 | A | 1/1987 | Häring |
| 4,704,922 | A | 11/1987 | Suketomo et al. |
| 4,773,302 | A | 9/1988 | Mizota et al. |
| 4,794,710 | A | 1/1989 | Häring |
| 4,843,744 | A | 7/1989 | Jensen |
| 4,917,565 | A | 4/1990 | Kourogi |
| 5,019,761 | A | 5/1991 | Kraft |
| 5,044,098 | A | 9/1991 | Berghefer |
| 5,136,795 | A | 8/1992 | Rosenberg |
| 5,655,318 | A | 8/1997 | Daniels |
| 5,697,172 | A | 12/1997 | Verseef |
| 5,720,122 | A | 2/1998 | McLellan |
| 5,941,921 | A | 8/1999 | Dasys et al. |
| 6,073,371 | A | 6/2000 | Goos et al. |
| 6,116,846 | A | 9/2000 | Bulkley |
| 6,263,595 | B1 | 7/2001 | Ake |
| 6,581,306 | B1 | 6/2003 | DiClementi |
| 6,640,468 | B2 | 11/2003 | Menze |
| 6,701,646 | B2 | 3/2004 | Schultz et al. |
| 6,711,837 | B2 | 3/2004 | Bloxdorf et al. |
| 6,757,994 | B1 | 7/2004 | Hendron |
| 6,792,704 | B2 | 9/2004 | Johnson |

IMPLEMENT WITH LINKAGE ASSEMBLY AND WORK ASSEMBLY WHEREIN WORK ASSEMBLY HAS DYNAMIC SKID SHOE AND A SCRAPING EDGE

This application is a Divisional of application Ser. No. 13/285,720, filed Oct. 31, 2011, which is a Continuation in Part of patent application Ser. No. 12/085,537, filed on May 27, 2008, now issued U.S. Pat. No. 8,046,939, which is a US National Stage Application of International Application No. PCT/US2006/045668, filed on Nov. 30, 2006, which is a Continuation of U.S. patent application Ser. No. 11/291,259, filed on Dec. 1, 2005.

FIELD

The disclosure is directed generally to an implement for attaching to a vehicle, the implement having a linkage assembly and a work assembly, such as for example a snow blower for clearing snow on a ground. The work assembly has a scraping edge and a dynamic skid shoe which functions with the linkage assembly to move the scraping edge over fixed obstructions.

BACKGROUND

Snow removal machines, such as snow plows, front end loaders, and snow blowers have a long history of use in removing snow from streets and highways. These snow removal machines have, for example, skid shoes that support front end components, such as the snow blower's auger housing. The skid shoes of these snow removal machines are set to be immobile with bolts, pins, or some kind of adjustment linkages when the snow removal machines are being operated. The skid shoes are one of the snow removal machine's points of contact of with the street surface. The skid shoes' contacts with the street surface have a critical functionality in the snow removal machine's operation. On a reasonably flat surface, according to many Operators' manuals, the skid shoes are pre-set to have a fixed distance from a horizontal that is assumed or estimated to be the flat surface. In such a configuration, the snow removal machine's blower component's cutting edge is able to clear snow in its path without scraping the surface of the street because the cutting edge is supported and guided by the skid shoes. This leaves a layer of snow still on the ground because the cutting edge is set to be above the surface of the ground. When surface is not reasonably flat, the skid shoes can fail to support the cutting edge from scraping the surface of the street. For example, a dip in the surface of the street can cause the skid shoe to become airborne when the dip is between the cutting edge of the snow blower and one of the wheels of the snow blower vehicle. This leads to the skid shoe not making contact with the surface of the street to support the weight of the snow blower and causes the cutting edge of the snow blower to drop from its fixed height above the street and to contact the surface of the street. This situation can damage the cutting edge and/or the surface of the street as the cutting edge strikes an obstruction on the street.

Therefore, prior art snow blower devices are generally used with the cutting edge of the snow blower set to be above the surface and do not contact the ground as a safety precaution to avoid the cutting edge from striking an obstacle and damaging the snow blower device and/or the user of the snow blower. Thus prior art snow blowers generally leave a layer of snow still on the ground.

BRIEF SUMMARY

The snow blower embodiments disclosed herein allow the cutting edge of the snow blower to contact the ground so that more of the snow can be cleared from the ground, and the cutting edge of the snow blower can follow the uneven surface conditions of the ground, such as going into dips in the ground to clear the snow from the dips, and when any part of the edge of the snow blower strikes an obstacle, the edge of the snow blower is automatically elevated to clear the obstacle.

The disclosure is directed to an implement, such as a work assembly, connected to vehicle. The work assembly of the implement is configured to be connected to a linkage assembly, and then to the vehicle. In this context, "vehicle" means a structure comprising a body, wheels, and a means for self-propulsion. Examples of the type of vehicles to which the apparatus may be most appropriately attached include all-terrain vehicles (ATVs), farm tractors, skid loaders, and pickup trucks. It is understood that the clearing accessory may be used for snow or other accumulations. The implement as attached to such vehicle provides for the scraping edge of clearing accessories to rise up and pass over fixed objects even on uneven surface conditions of the ground.

An embodiment of the work assembly has an edge, and the work assembly is connected to one or more weight bearing component(s). The weight bearing component(s) bears at least some of the weight of the accessory and can be configured such that the scraping edge does not bear the full weight of the work assembly. An example of the weight bearing component is a skid shoe operably connected to or near the rear of the work assembly.

An embodiment of a dynamic skid shoe includes a surface contact component for contacting a street surface, a dynamic component operably connected to the surface contact component for providing vertical movement of the surface contact component, and a hydraulic fluid circuit including a pressure providing component fluidily connected to the dynamic component.

On an uneven ground surface, when the edge of the work assembly strikes an obstruction, such as a fixed object, or an immovable object, the dynamic component is configured to be in a rigid state, the surface contact component is on the ground, and the cutting edge is elevated to allow the edge to ride over the obstruction.

BRIEF DESCRIPTION OF THE DRAWINGS

FIG. 1A shows the bucket riding over a flat surface; FIG. 1B shows the bucket riding up over a fixed object which it initially struck.

DETAILED DESCRIPTION

The disclosure relates to an implement operably connected to a work assembly having an edge and a heel. The work assembly is configured for connecting to a vehicle through a linkage assembly which is attachable to the vehicle. When the linkage assembly is in a first configuration, the edge and a weight bearing component(s) of the work assembly are both resting on ground, or the edge is just slightly above the ground and the weight bearing component(s) is(are) resting on ground. When the linkage assembly is in the second configuration, the weight bearing component(s) of the accessory is(are) on the ground and the edge is elevated to allow the edge to ride up and over an obstruction. The weight bearing component(s) is(are) configured to be dynamic and move in a vertical direction so that the weight bearing component(s) meet the surface even on uneven surface conditions of the ground. Further, the edge that is resting on the ground can also move along the surface of the uneven surface conditions of the ground for clearing substantially all or most of the materials resting on the ground. When the linkage assembly is to be in the second configuration, the weight bearing component (s) is(are) configured to become rigid, in other words, the weight bearing component(s) lock(s) to a particular length vertically and stops moving along the vertical direction. The rigid weight bearing component(s) bear(s) the weight or part of the weight of the work assembly even when there is a dip (or low point) on the surface, and provides for a pivot point at the heel or skid shoe portion of the work assembly for the edge to ride up and over the obstruction.

The disclosure also relates to an apparatus for attaching an accessory having a scraping edge and a heel to a vehicle and includes a linkage assembly attachable to the vehicle. The linkage assembly has first and second pivot axes pivotally connecting with the accessory. The first pivot axis is beneath the second pivot axis. The linkage assembly has first and second configurations: the first configuration includes the first axis located in a first position horizontally relative to the second axis, the second configuration includes the first axis located in a second position horizontally relative to the second axis. The second position is horizontally separated in a direction toward the accessory relative to the first position. When the scraping edge of the accessory strikes an immovable object, the linkage assembly moves from the first to the second configuration. When the linkage assembly is in the first configuration, the scraping edge and the heel of the accessory are both resting on ground. When the linkage assembly is in the second configuration, the heel of the accessory is on the ground and the scraping edge is elevated to allow the scraping edge to ride over the immovable object.

Figure 1A:
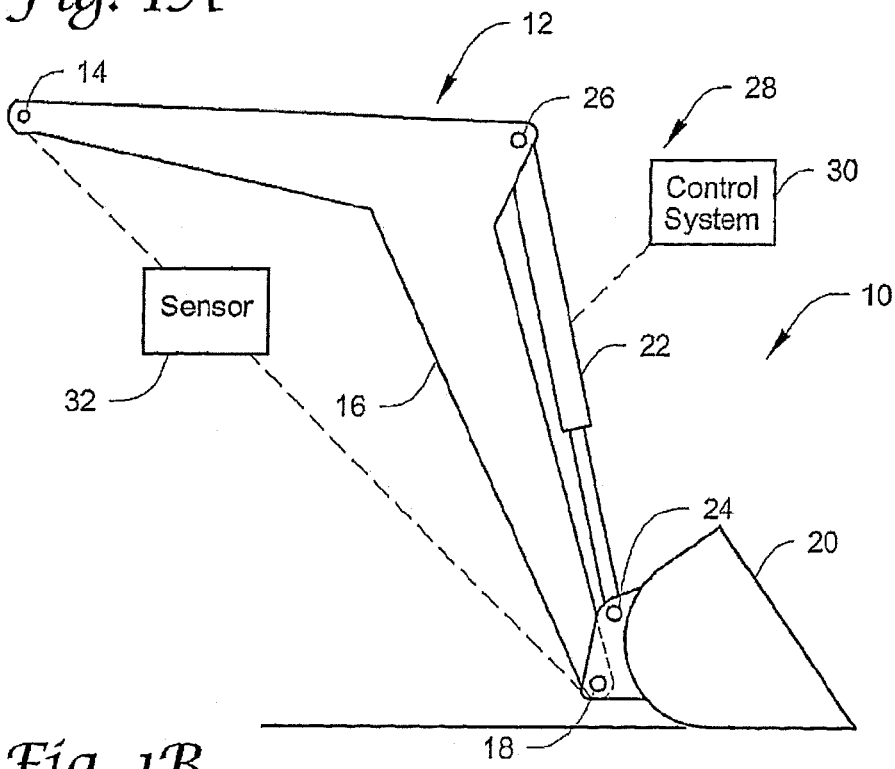
FIGS. 1A and 1B illustrate schematically a side view of an embodiment, including a sensor and bucket tilt control system.
Figure 1B:
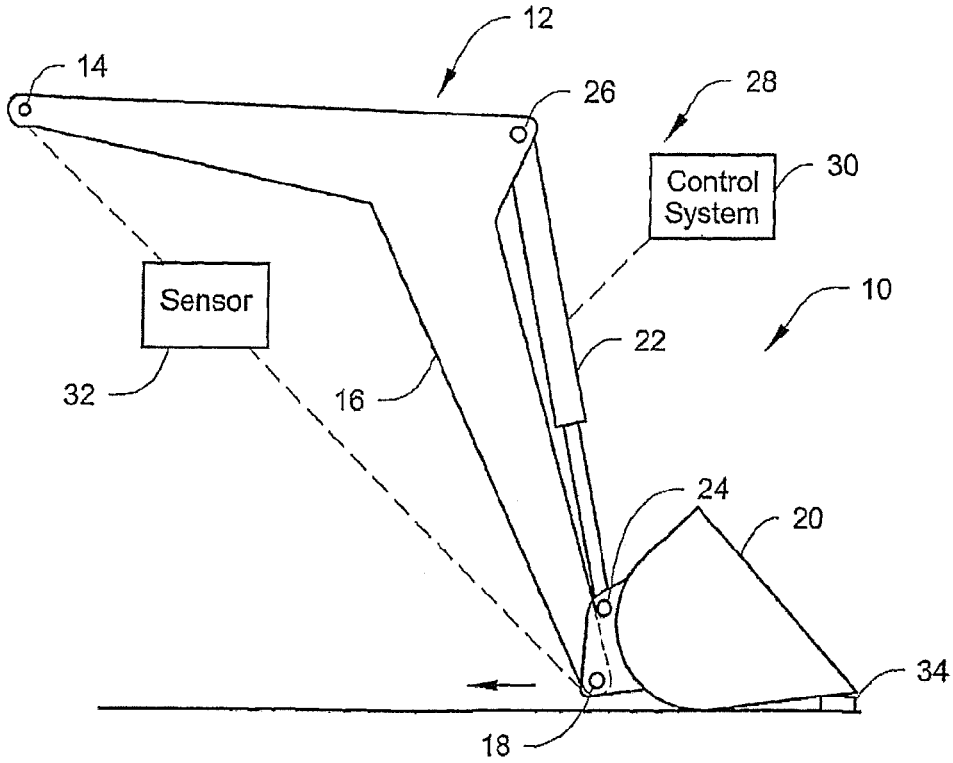
Figure 2:
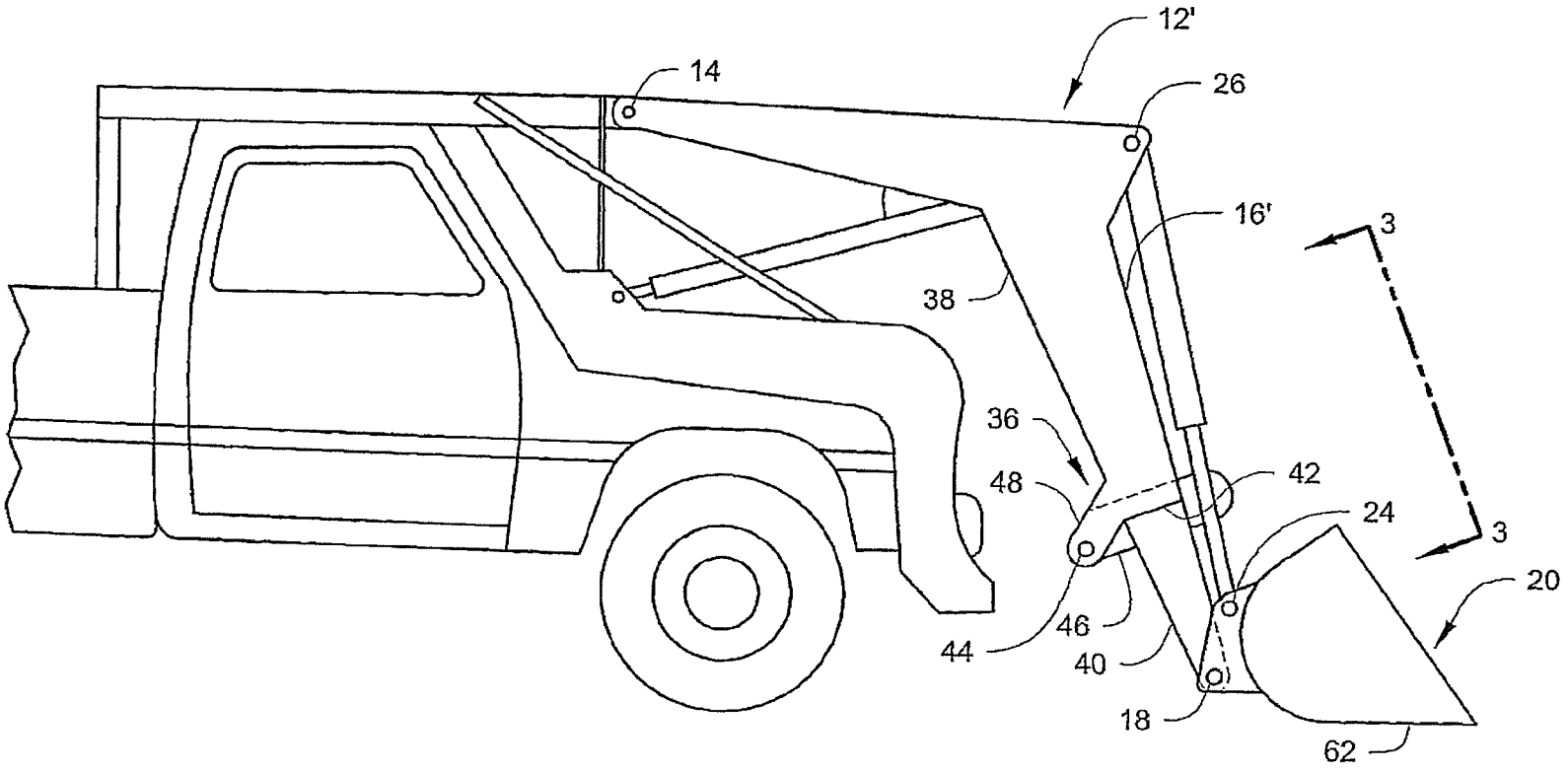
FIG. 2 is a side view of another embodiment.

In one embodiment, the linkage assembly is mounted to a front end loader apparatus. Referring to the drawings, wherein like reference numerals designate identical or corresponding parts throughout the several views, and more particularly to FIGS. 1A and 1B, the front end loader apparatus is designated generally by the numeral 10. Designations such as front, back, top, bottom, right side and left side are to be referenced to the vehicle, particularly from the perspective of the vehicle driver. Apparatus 10 includes a frame assembly 12 attached to the vehicle (not shown). Frame assembly 12 includes a pair of downwardly projecting legs 16 which are pivotally attached at first pivot points 18 to bucket 20. Hydraulic cylinders 22 are pivotally attached at second pivot points 24 to bucket 20 and also to frame assembly 12 near the top of downwardly projecting legs 16 at third pivot points 26. The frame assembly 12 is pivotally attached at vehicle attachment pivot points 14. In the first embodiment, the hydraulic cylinders 22 are part of a mechanism 28 controlled by control system 30, which in conjunction with sensor 32, causes the bucket 20 to tip back upon striking an immovable object 34 as shown in FIG. 1(B). Sensor 32 senses a change in distance between first and vehicle attachment pivot points 18 and 14 or, alternatively, a change in velocity of bucket 20 or an impact deceleration of bucket 20. That is, when bucket 20 has met immovable object 34, sensor 32 sends a signal to control system 30 which determines if a threshold value of the parameter measured has been reached. If the threshold value has been met, control system 30 actuates a contraction of hydraulic cylinders 22 so that bucket 20 tips appropriately up at the scraping edge and rides up and over the immovable object 34.

Figure 3:
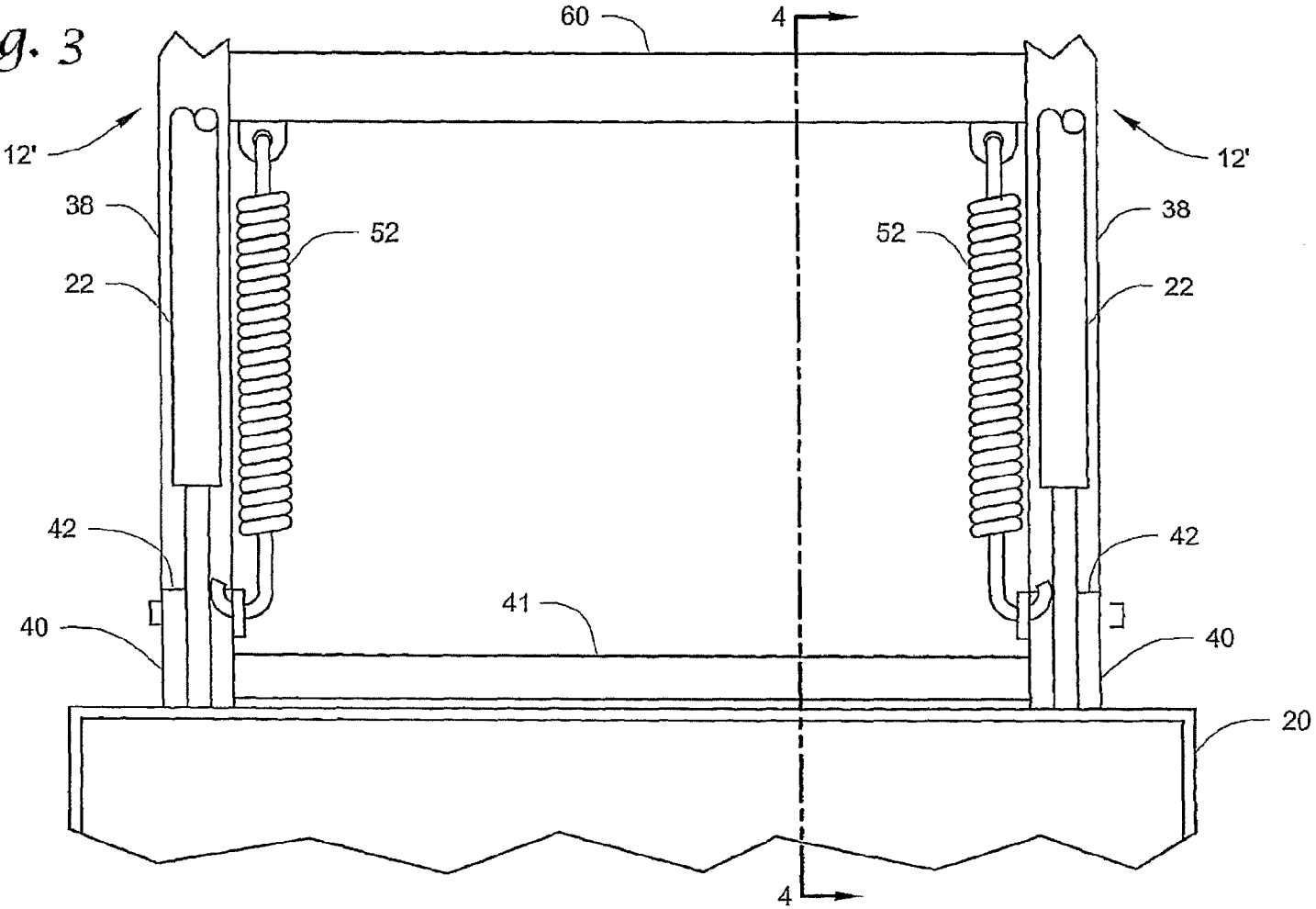
FIG. 3 is an enlarged plan view of the lower bucket assembly as shown in FIG. 2 taken along auxiliary line 3-3.

In another embodiment as shown in FIGS. 2-5B, there are two downwardly projecting legs 16' which have hinged joints 36 which allow bucket 20 to tip relative to frame assembly 12'. Each downwardly projecting leg 16' has upper and lower portions 38, 40 separated at a break location 42. The two upper portions 38 are rigidly connected by a first cross member 60 as shown in FIG. 3. The two lower portions 40 are rigidly connected by a second cross member 41. The upper portions 38 and lower portions 40 of each of the downwardly projecting legs 16' are rotatably fastened together at fourth pivot point 44. Pivot points 44 have axes lying parallel and located rearwardly of break locations 42. A lever arm 46 is fixedly attached to the lower portion 40 of each of the downwardly projecting legs 16'. Alternatively, lever arm 46 could be a unitary part of the lower portion 40 of the downwardly projecting leg 16'. A mating leg 48 extends rearwardly from each of the upper portions 38 of downwardly projecting legs 16' so that the rearward end of lever arm 46 and mating leg 48 are pivotally attached together at the fourth pivot point 44. The lower portions 40 of the downwardly projecting legs 16' are attached to bucket 20 at first pivot points 18.

Working in conjunction with hinged joints 36 are hinged joint closing devices 50. With respect to FIGS. 4A and 4B, a hinged joint closing device 50 includes a coil spring 52. One end 54 of the spring 52 is attached to a forwardly extending portion 56 of lever arm 46. The other end 58 of the spring 52 is attached to the first cross member 60 which rigidly connects the upper portions 38 of the downwardly projecting legs 16'. As shown in FIG. 3, there are similar hinged joint closing devices 50 associated with each of the downwardly projecting legs 16'.

Figure 4A:
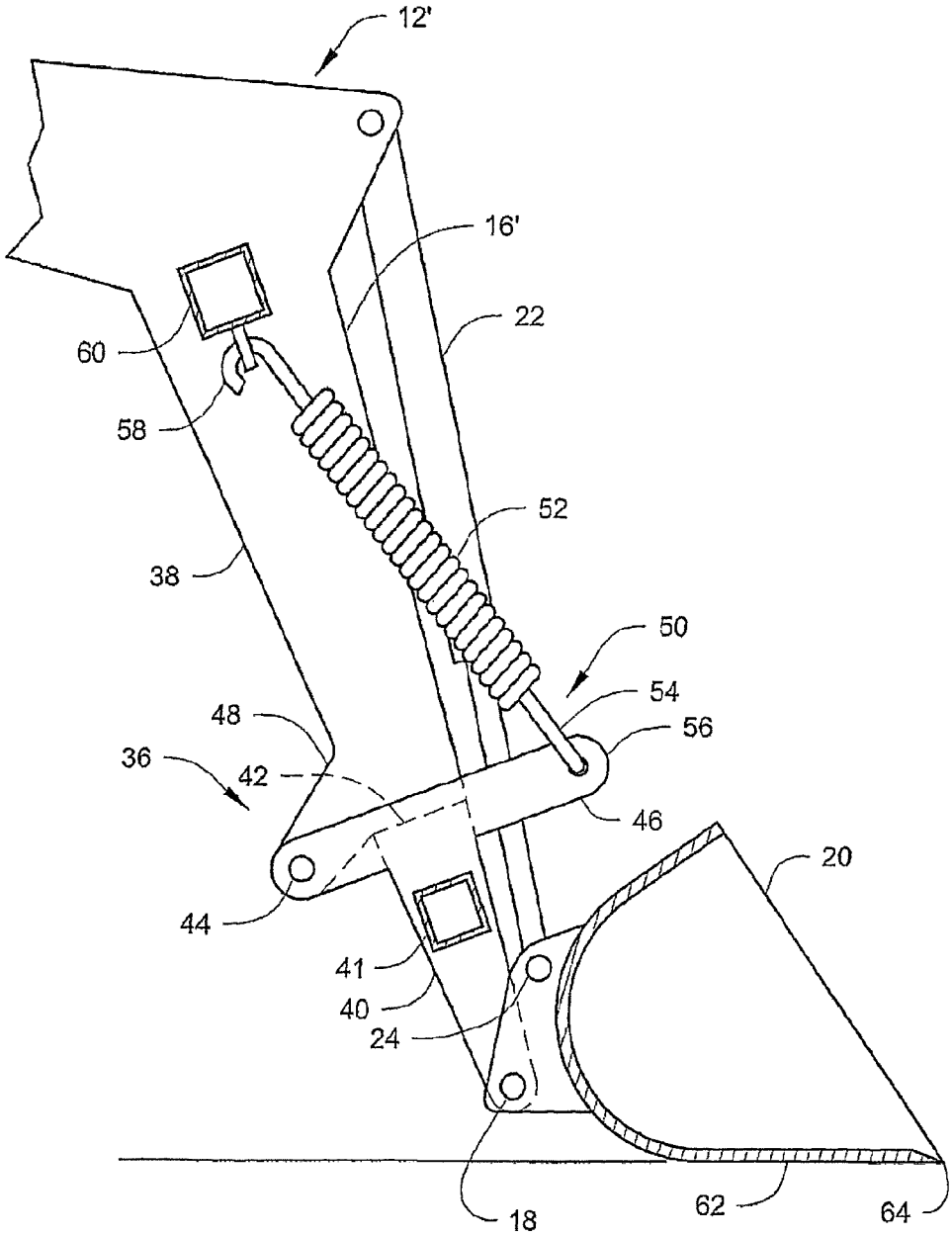
FIG. 4A is a sectional view of the lower bucket assembly as shown in FIG. 3, taken along section line 4-4, showing the assembly in the undeflected position.
Figure 4B:
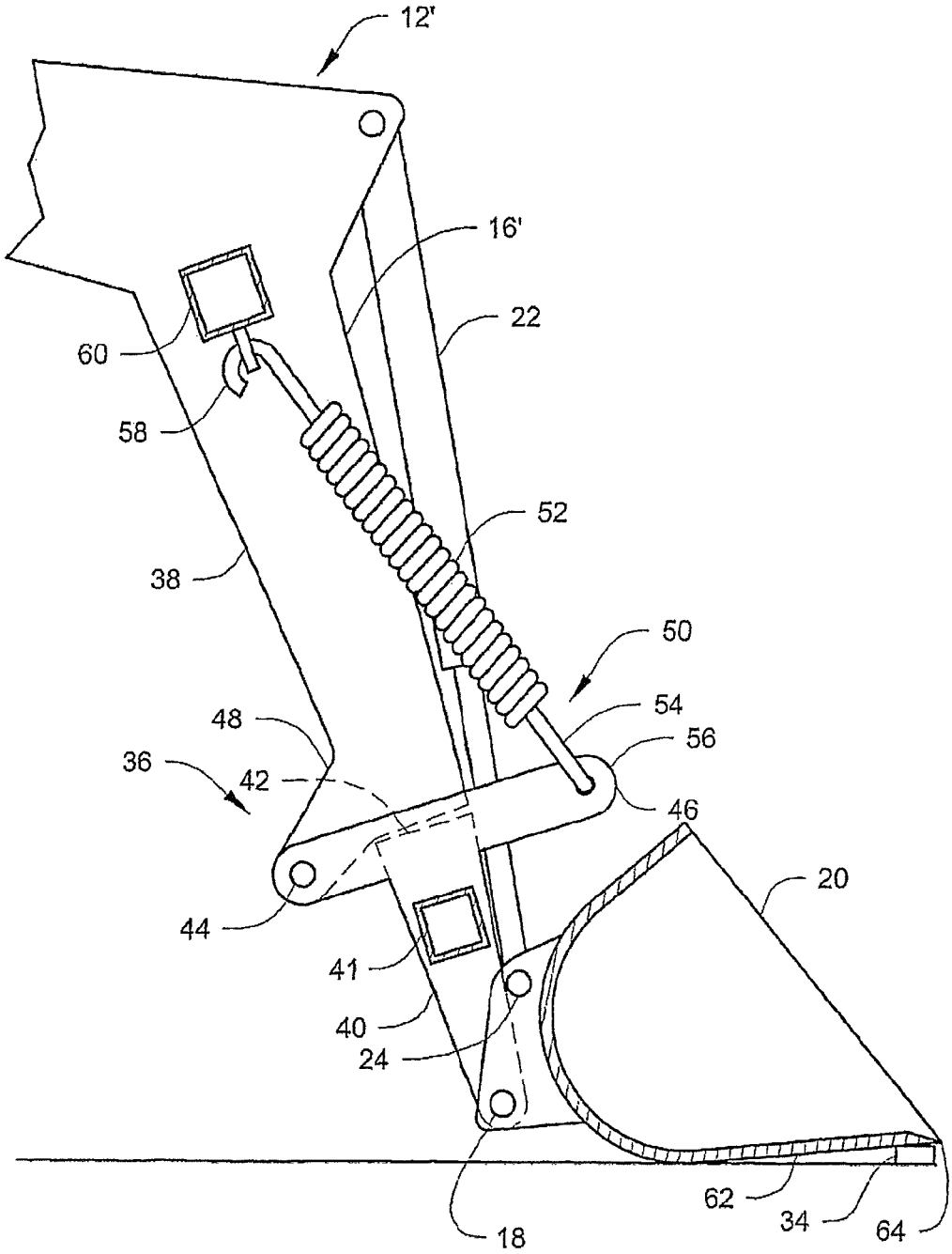
FIG. 4B is a sectional view of the lower bucket assembly as shown in FIG. 3, taken along section line 4-4, showing the assembly in the deflected position as the bucket rides up over a fixed object.

In use, apparatus 10 is positioned so that the bottom 62 of bucket 20 is flat on the ground so that the front edge 64 scrapes, for example, snow and ice appropriately along the ground. When front edge 64 strikes an immovable object 34 as shown in FIG. 4B, the lower portions 40 of the downwardly projecting legs 16' pivot backward about the fourth pivot points 44. As the lower portion of the downwardly projecting legs 40 pivot backward, the bucket 20 pivots about the second pivot points 24 and first pivot points 18 thereby allowing the front scraping edge 64 of the bucket 20 to lift up and over the immovable object 34. The heel of the bucket remains on the ground. Hydraulic cylinder 22 maintains a constant length during these operations. The impact force of the immovable object 34 is counteracted by the hinged joint closing device 50, or more particularly, springs 52. When the impact force of the immovable object 34 overcomes the counteracting spring force, which is determined by the spring constant, as well as the length of the lever arm 46 relative to the fourth pivot points 44, the front scraping edge 64 of the bucket 20 will lift up and over the immovable object 34 as shown in FIG. 4B. Once the immovable object 34 has been cleared, the springs 52 will pivot the lower portion 40 of the downwardly projecting legs 16' about the fourth pivot points 44 so that the upper portions 38 and the lower portions 40 lie directly adjacent one another in the area of break locations 42, thereby resetting the hinged joint closing device 50.

Figure 5A:
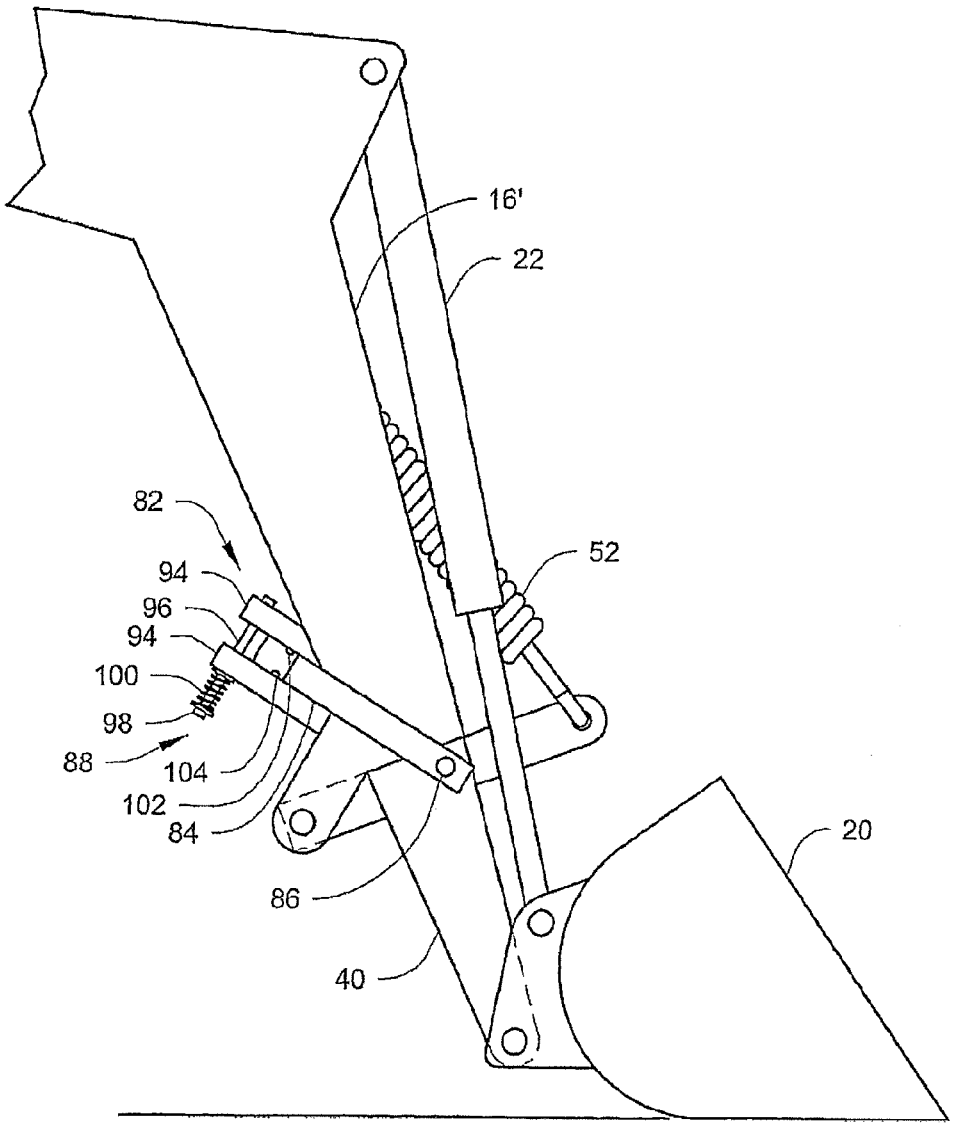
FIG. 5A is a side view of the lower bucket assembly, which includes a nipple and détente mechanism, showing the assembly in the undeflected position.
Figure 5B:
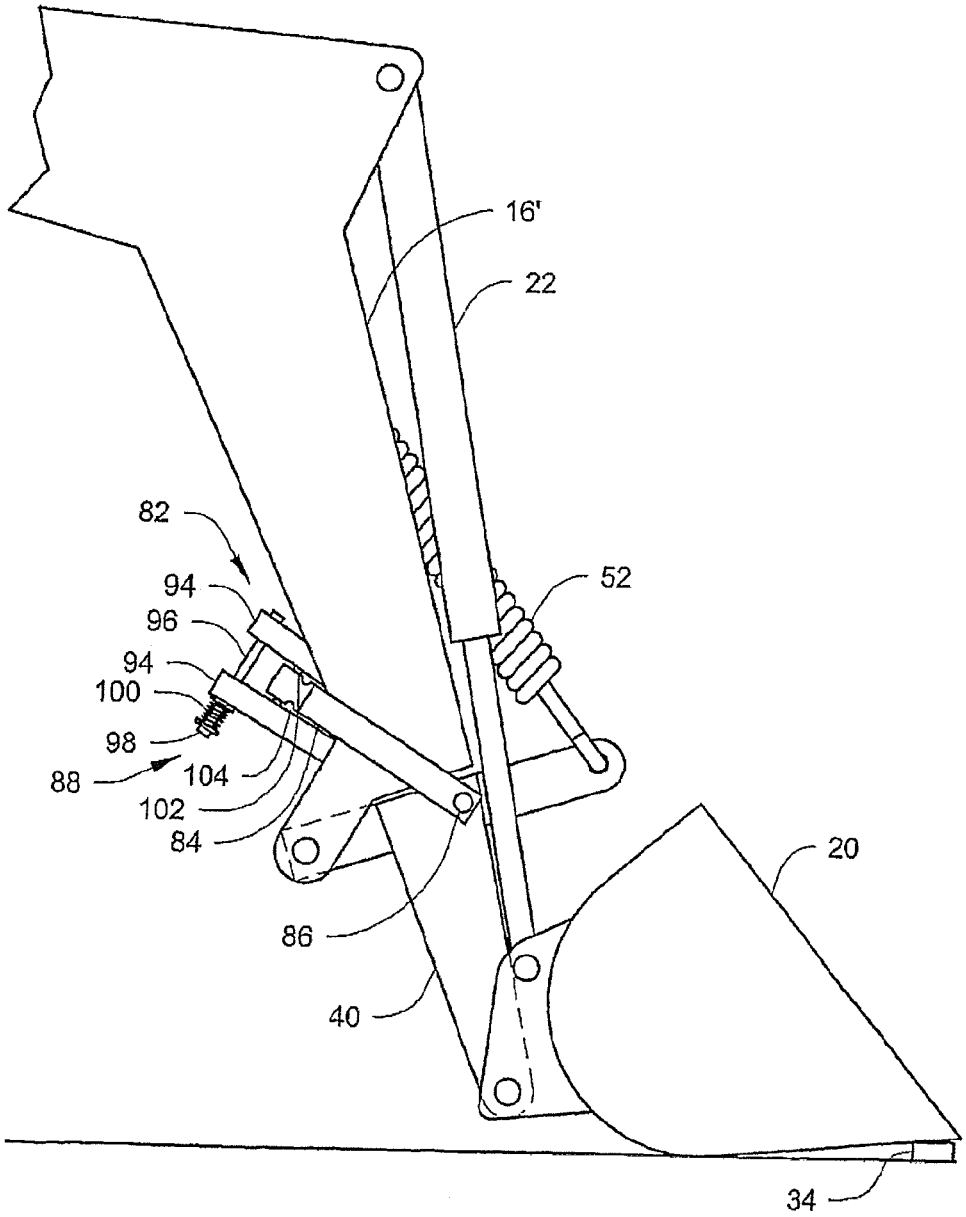
FIG. 5B is a side view of the lower bucket assembly, which includes a nipple and détente mechanism, showing the assembly in the deflected position.

In a further embodiment of apparatus 10 as shown in FIGS. 5A and 5B, a sensor in the form of a mechanical nipple/détente assembly 82 is disclosed. Nipple/détente assembly 82 includes a détente member 84 pivotally attached to both the right and left sides of the lower portion 40 of each downwardly projecting leg 16' at pivot point 86. The detent member 84 additionally provides a stop which prevents the over-rotation of the lower portion 40 of the downwardly projecting leg 16'. A nipple sub-assembly 88 is pivotally attached to the inside of the upper portion 38 of each downwardly projecting leg 16'. Nipple sub-assembly 88 includes a pair of plates 94, on either side of détente member 84, held together with a bolt 96 and nut 98. A coil spring 100 is provided on bolt 96 between nut 98 and one of plates 94. The combination of nut and bolt 98, 96 and spring 100 provides a force adjustment for nipple/détente assembly 82. That is, if nut 98 is tightened against spring 100, it takes more force to separate plates 94 and allow détente member to pull away and further allow hinged joints 36 to open. Protuberance nipples 102 are provided on each of the plates 94, while indention détentes 104 are located to receive nipples 102 when hinged joints 36 are closed. It is preferred that nipple/détente assembly 82 be a part of appropriate embodiments above.

In use, when an immovable object 34 is struck, if a force is generated above the preset threshold to which spring 100 is adjusted, détente member 84 overcomes the force of the compression spring 100 thereby releasing détente member 84 which allows lower portion 40 to rotate so that the hinge joints 36 open as depicted in FIG. 5B. Once the hinged joints 36 close, nipple/détente assembly 82 resets as in FIG. 5A.

The use of nipple/détente assembly 82 is readily tailored to snowplowing conditions, and may even provide a mechanism for locking out the bucket tilting function during activities such as excavating soil and the like for the front-end loader vehicle.

Figure 6:
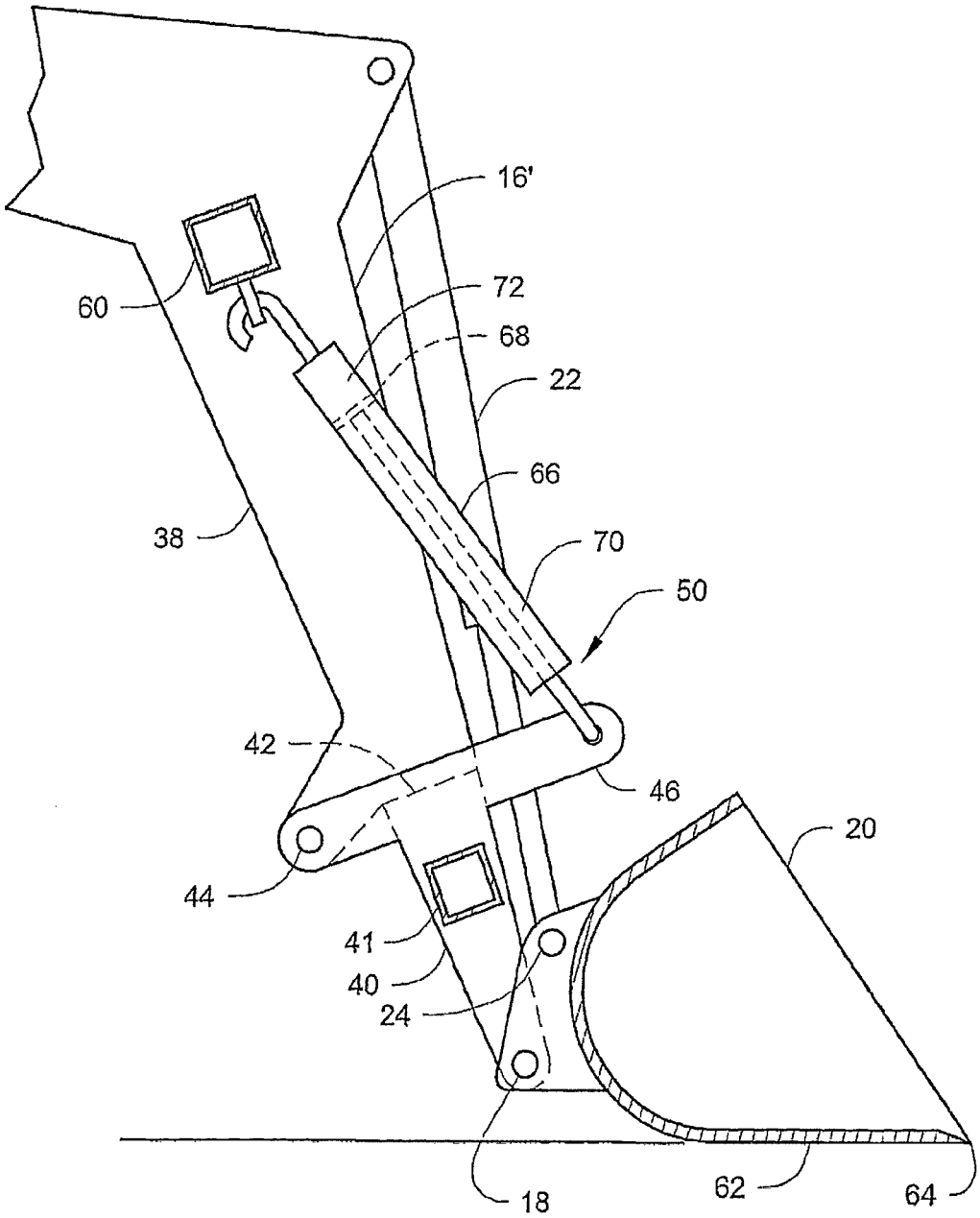
FIG. 6 is a sectional view of the lower bucket assembly of a further embodiment as shown generally in FIG. 3, taken along section line 4-4, showing the assembly in the undeflected position.
Figure 7:
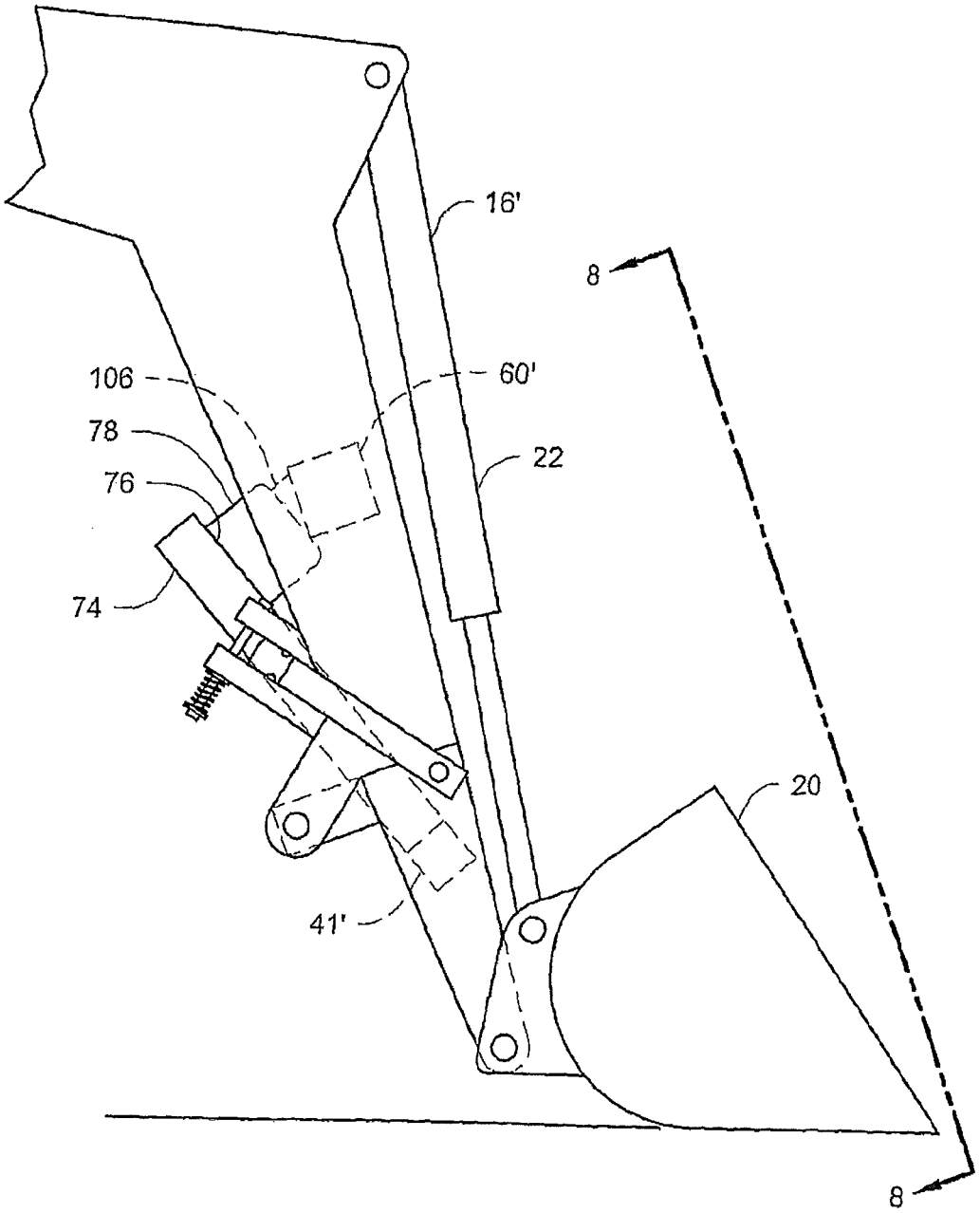
FIG. 7 is a side view of the lower bucket assembly of still another embodiment, showing the assembly in the undeflected position.
Figure 8:
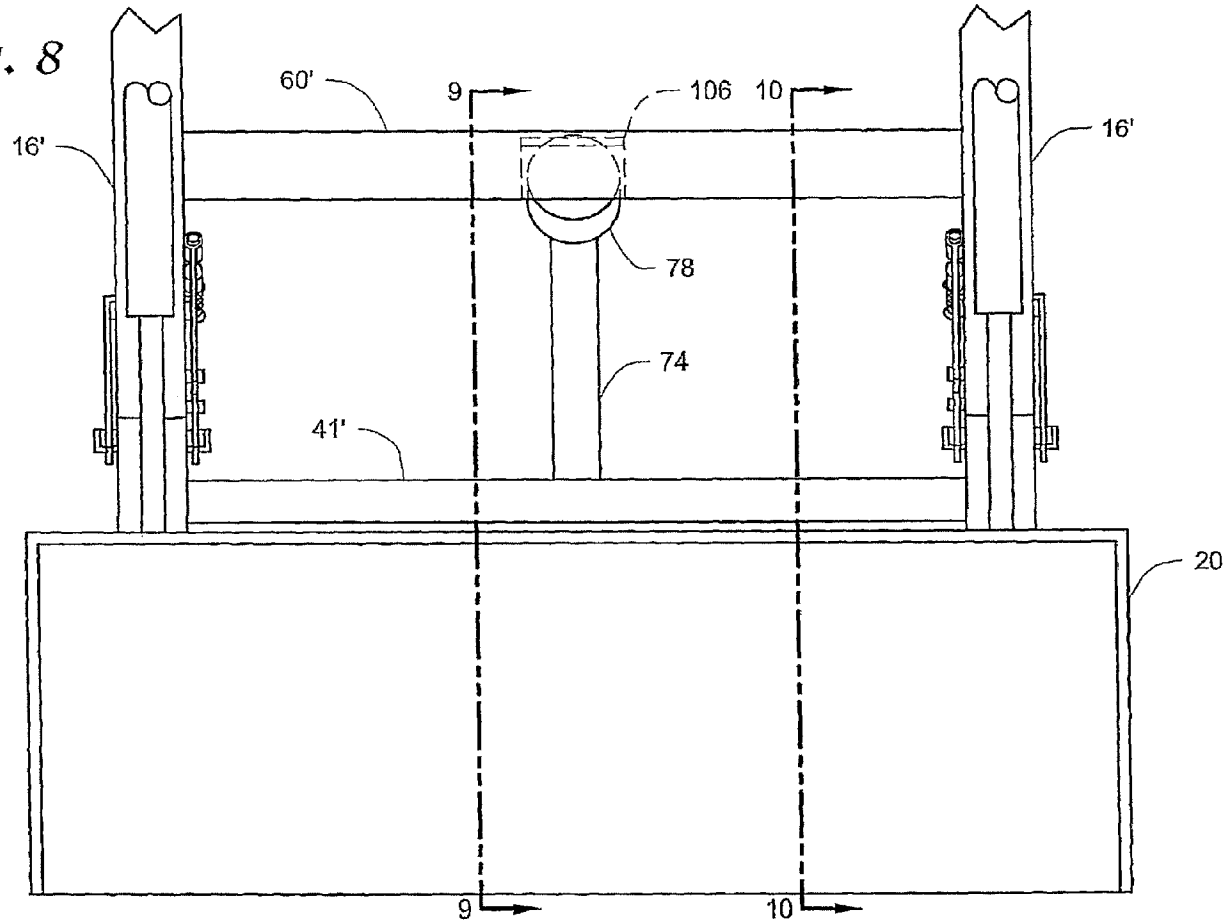
FIG. 8 is an enlarged plan view of the lower bucket assembly as shown in FIG. 7 taken along auxiliary line 8-8.
Figure 9:
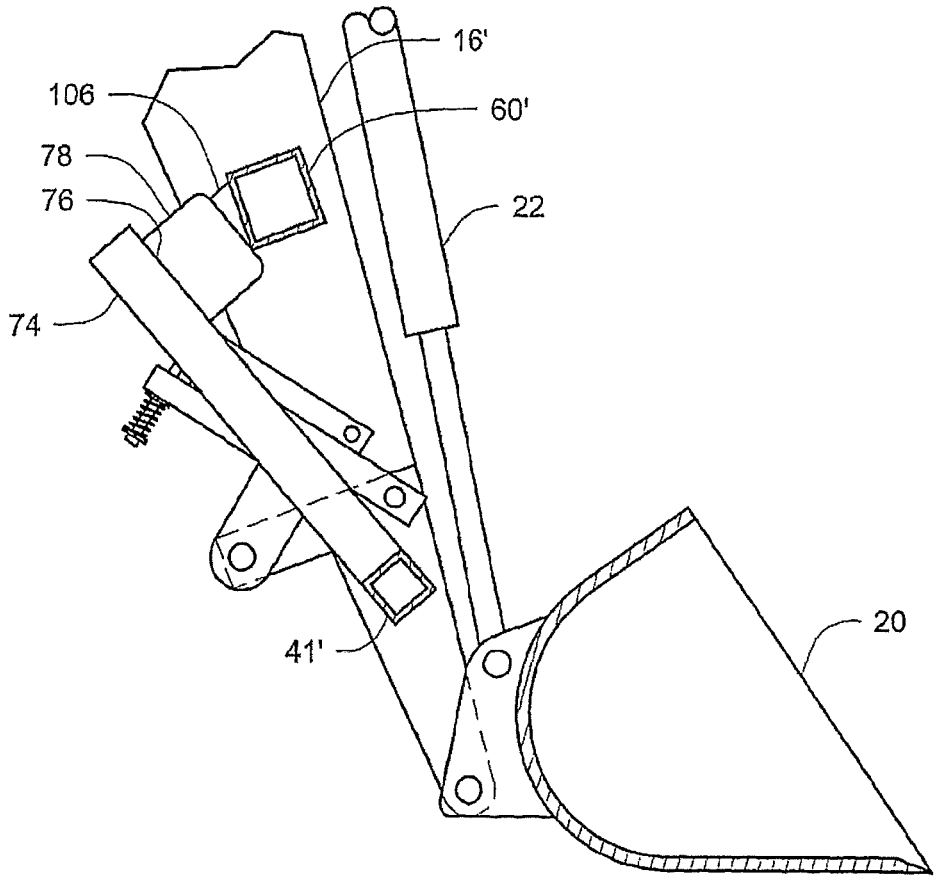
FIG. 9 is a sectional view of the lower bucket assembly as shown generally in FIG. 8, taken along section line 9-9, showing the assembly in the undeflected position.
Figure 10A:
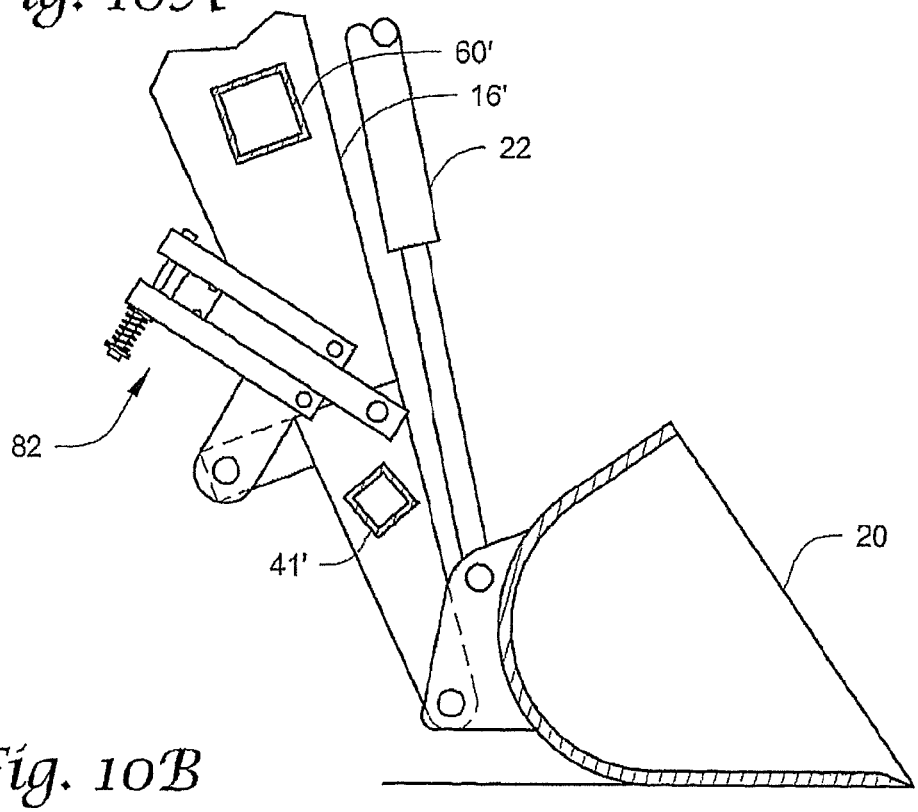
FIG. 10A is a sectional view of the lower bucket assembly as shown in FIG. 8, taken along section line 10-10, showing the nipple and détente mechanism when the assembly is in the undeflected position.
Figure 10B:
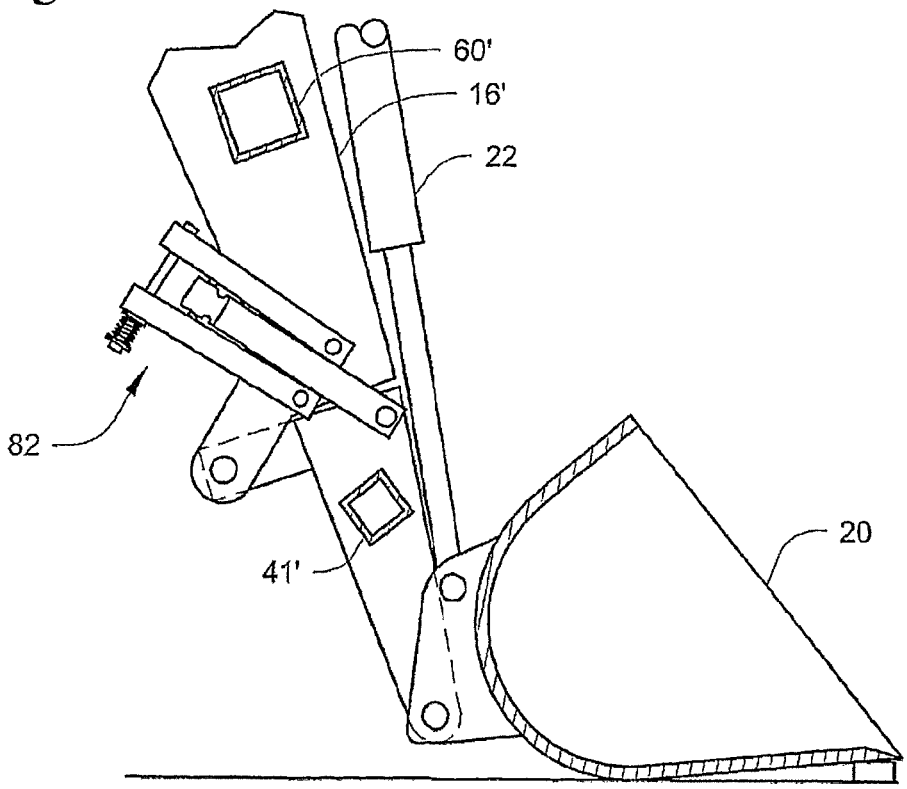
FIG. 10B is a sectional view of the lower bucket assembly as shown in FIG. 8, taken along section line 10-10, showing the nipple and détente mechanism when the assembly is in the deflected position.

In still another embodiment as shown in FIG. 6, springs 52 of the embodiment of FIGS. 2-5B are replaced by fluid-filled (pneumatic or hydraulic) cylinders 66. The rest of the apparatus is as disclosed. As shown in broken lines, a fluid-filled cylinder 66 includes a piston 68 having first and second chambers 70, 72 on either side of piston 68. When bottom 62 of bucket 20 is sliding along the ground at a level orientation, the first chambers 70 are maintained at a greater pressure than the pressure in the second chambers 72 such that the fluid-filled cylinders 66 provide a biasing force to the end of the lever arms 46.

When front scraping edge 64 strikes an immovable object 34, as similarly shown in FIG. 5B, the lower portions 40 of the downwardly projecting legs 16' pivot backward about the fourth pivot points 44. As the lower portions of the downwardly projecting legs 40 pivot backward, the bucket 20 pivots about the second pivot points 24 and first pivot points 18 thereby allowing the front edge 64 of the bucket 20 to lift up and over the immovable object 34. The first pivot points 18 move in the direction toward bucket 20 relative to the second pivot points 24. Hydraulic cylinder 22 maintains a constant length during these operations. The impact force of the immovable object 34 is counteracted by the hinged joint closing device 50, or more particularly fluid-filled cylinders 66. When the impact force of the immovable object 34 overcomes the counteracting force provided by the fluid-filled cylinders, the front edge 64 of the bucket 20 will lift up and over the immovable object 34. Once the immovable object 34 has been cleared, the fluid-filled cylinders 66 will pivot the lower portion 40 of the downwardly projecting legs 16' about the pivot points 44 so that the upper portions 38 and the lower portions 40 lie directly adjacent to one another in the area of break locations 42, thereby resetting the hinged joint closing device 50.

In the embodiment as shown in FIGS. 7-10B, a different type of fluid-filled or elastomeric device is used. A lever arm 74 is solidly attached to the second cross member 41' near its midpoint. The top end portion 76 of lever arm 74 includes a bumper member 78 comprising a volume-constrained fluid-filled bag, or an elastomeric member, which presses against a bumper coupler member 106 which is attached to a first cross member 60' near its midpoint. When bucket 20 strikes an immovable object 34 causing hinged joint 36 to open, lever arm 74 presses the bumper member 78 against the bumper coupler member 106 thereby causing it to deform. This deformation stores energy in the bumper member 78 as either increased fluid pressure in the case of the volume-constrained bag, or as stored elastic energy in the case of an elastomeric member. The deformation of the bumper member 78 opposes the opening of hinged joints 36 and urges them closed. As this occurs, bucket 20 rides over immovable object 34 as discussed earlier.

Figure 11A:
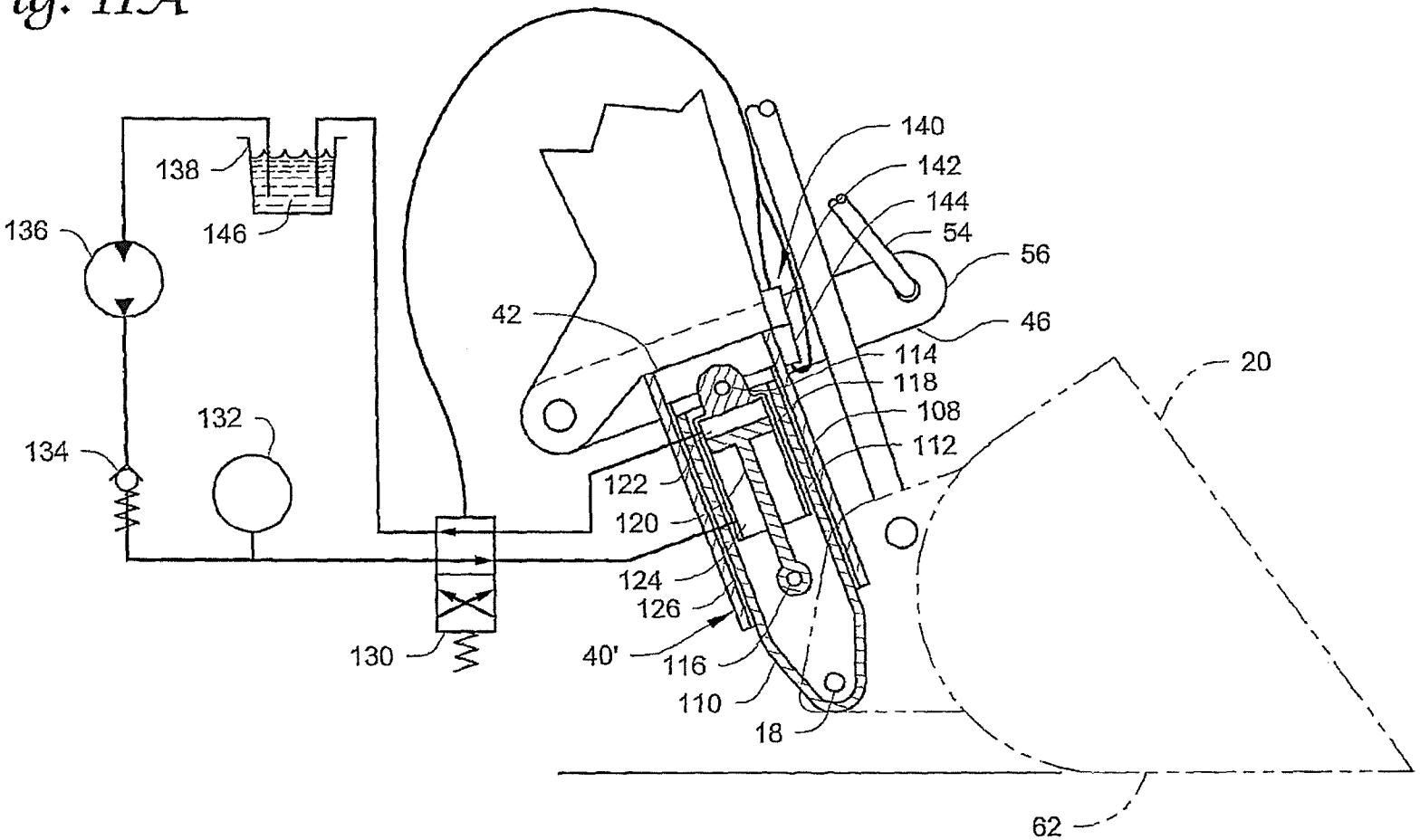
FIG. 11A is a partial side view of the lower bucket assembly of yet another embodiment as shown in FIG. 2, showing a divided lower portion of a downwardly projecting leg, and a hydraulic cylinder (and associated hydraulic circuit) which controls its overall length, in the undeflected position.
Figure 11B:
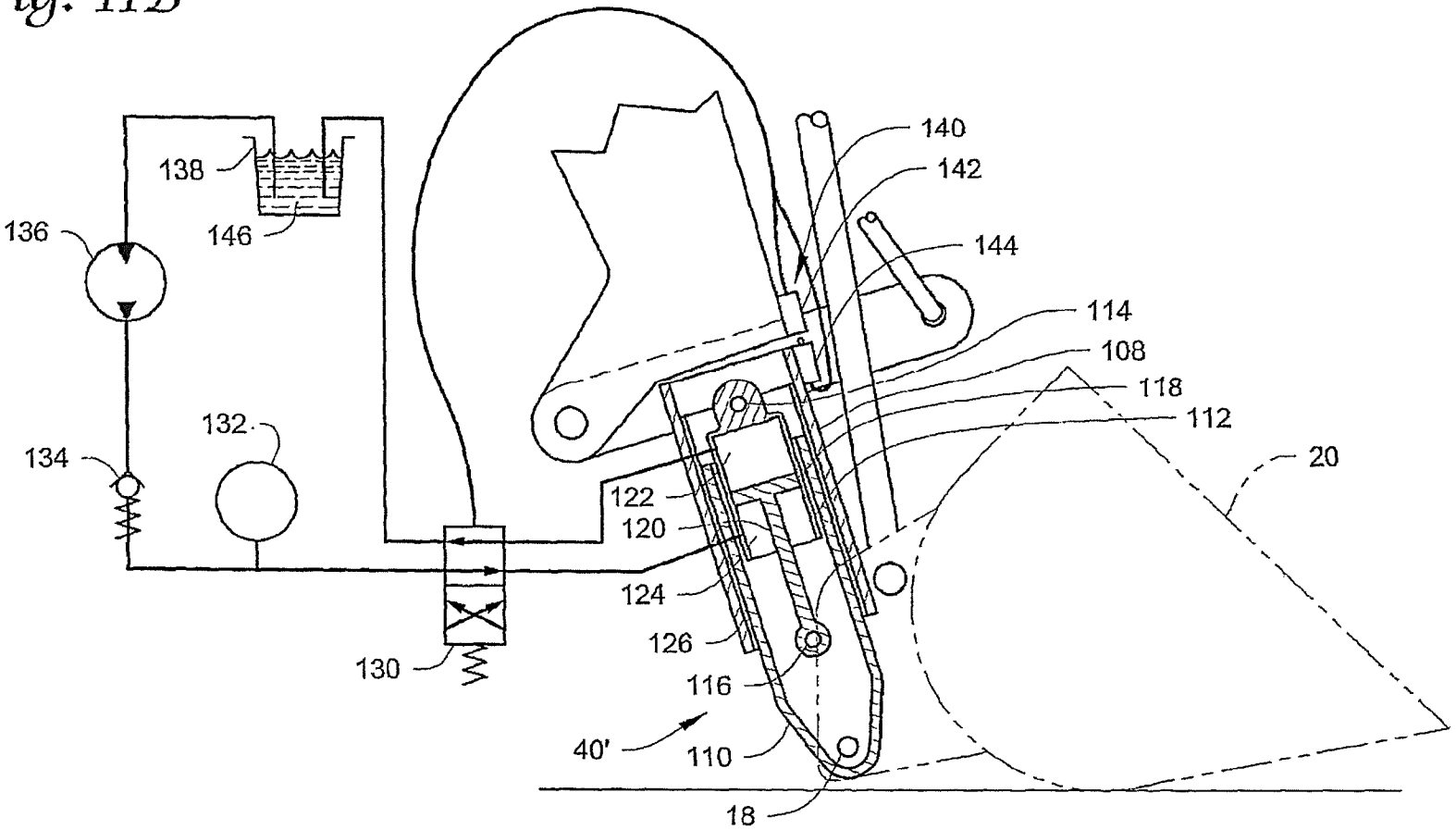
FIG. 11B is a partial side view of the lower bucket assembly of the embodiment of FIG. 11A as shown in FIG. 2, showing a divided lower portion of a downwardly projecting leg, and a hydraulic cylinder (and associated hydraulic circuit) which controls its overall length, in the deflected position.
Figure 12A:
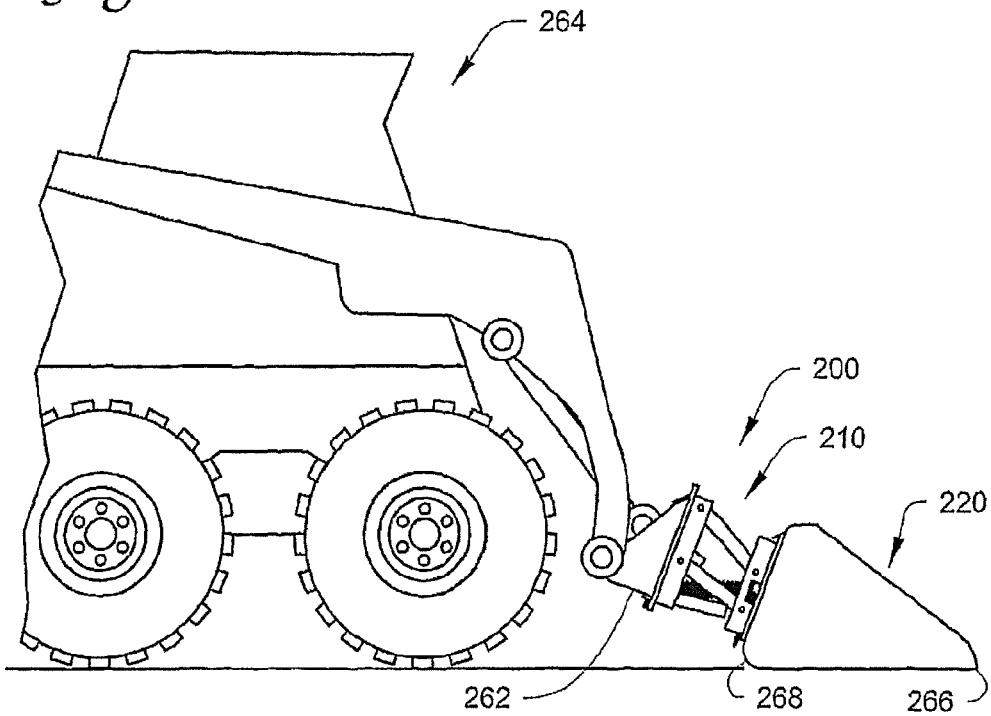
FIG. 12A is a side view of a loader with a quadrilateral linkage connecting a bucket to the loader, when the quadrilateral linkage is not activated.
Figure 12B:
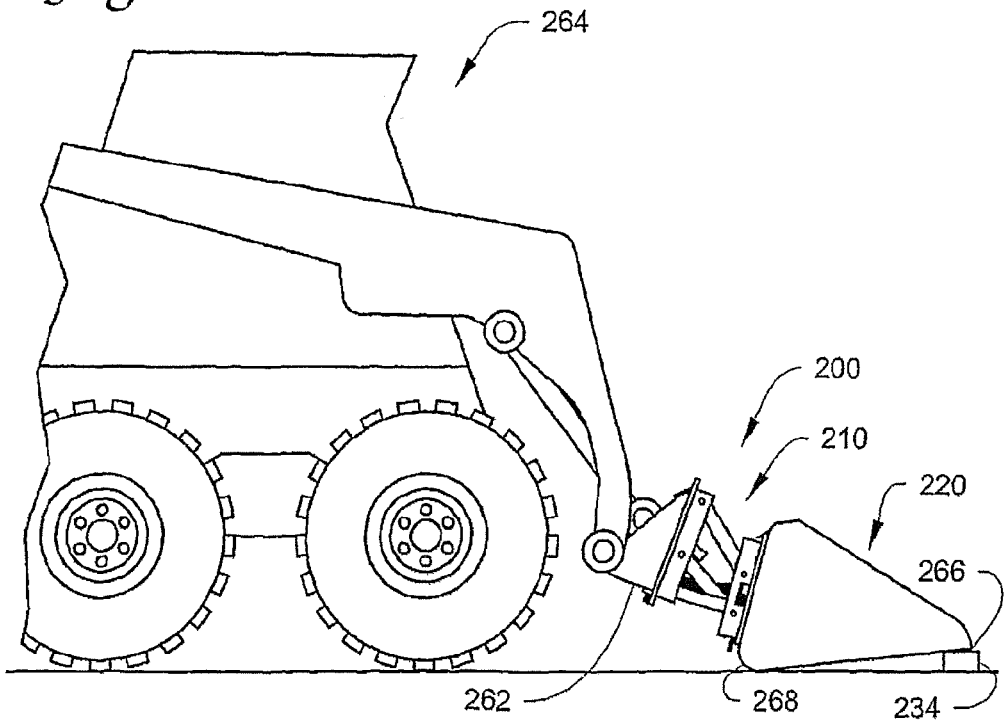
FIG. 12B is a side view of a loader with a quadrilateral linkage connecting a bucket to the loader, when the quadrilateral linkage is activated.

In the embodiment as shown in FIGS. 11A and 11B, a lower portion of a downwardly projecting leg 40' is divided into a top portion 108 and a bottom portion 110. The top portion 108 is slidably connected to the bottom portion 110 with a bearing member 126 there between, and a hydraulic cylinder 112 is attached to the top portion 108 at top hydraulic cylinder coupling 114, and to the bottom portion 110 at bottom hydraulic cylinder coupling 116. The hydraulic cylinder 112 contains a hydraulic cylinder piston 118 and a hydraulic cylinder piston rod 120. An upper cavity 122 is located in the hydraulic cylinder 112 above the piston 118, and a lower cavity 124 exists below the piston 118. A hydraulic circuit 150 activates the hydraulic cylinder 112. The hydraulic circuit 150 includes a reservoir 138, a hydraulic pump 136, a check valve 134, a fast-acting gas-filled accumulator 132, and a solenoid valve 130. A sensor 140 is connected to the solenoid 130 and determines its position. In one embodiment, the sensor 140 comprises a switch 142, 144, located across break location 42.

In use, the lower portions of the downwardly projecting legs appear as in FIG. 11A. The hydraulic pump 136 supplies pressurized hydraulic fluid 146 through check valve 134 to the fast-acting gas-filled accumulator 132. Solenoid valve 130 is in a position which supplies the hydraulic pressure from the hydraulic pump 136 and fast-acting gas-filled accumulator 132, preferably nitrogen accumulator, to the lower cavity 124 of the hydraulic cylinder 112 which maintains the lower portion of the downwardly projecting leg 40' in its shortest configuration. When an immovable object is struck by the bucket 20, the break location 42 opens up sufficiently to cause sensor 140 to send a signal to the solenoid valve 130, causing it to switch to the location depicted in FIG. 11B. When the solenoid valve 130 shuttles its position, hydraulic fluid 146 immediately rushes to the upper cavity 122 of the hydraulic cylinder 112, thereby causing the hydraulic cylinder piston 118 to move downward, thus pushing the bottom portion of the lower portion of the downwardly projecting leg 110 to move away from the top portion of the lower portion of the downwardly projecting leg 108. This extension causes the bucket 20 to tilt upwardly about the first pivot point 18 and the second pivot point 24. Furthermore, the mechanics of elongating the lower portion of the downwardly projecting leg 40' are such that the degree of upward tilting of the bucket 20 is amplified by this increased length.

The mechanism of this embodiment is preferably used as a safety device in cases where the magnitude of the collision impulse is large, e.g. where large immovable objects are struck by the bucket 20, such as in the case when a curb is struck with the bucket 20. The threshold of sensor 140 or switch 142, 144 would be set so that this mechanism is activated only upon hitting an immovable object large enough or rigid enough so as to cause a large impulse to the loader and its occupant(s). After such a jarring collision, the mechanism would be reset by the operator of the vehicle, after inspecting the vehicle for damage. By amplifying the amount of rotation which bucket 20 may make in the case of extreme collisions, injury to the occupant(s) and damage to the loader can be prevented.

In yet a further embodiment as shown in FIGS. 12A-17B, the linkage assembly 200 includes a quadrilateral linkage 210 and connects a clearing accessory and a vehicle. It will be appreciated that the vehicle may be ATVs, farm tractors, skid loaders, pickup trucks, or other vehicles and that the clearing accessory may clear snow, manure or other material.

The linkage assembly 200 includes a front plate 260 that connects conventionally to the bucket 220 of the loader vehicle 264 and a rear plate 212 that connects conventionally to the vehicle. With respect to the quadrilateral linkage 210, the front plate 260 connects at braces 304 to a first pair of arms 216 at first pivot points 218 and to a second pair of arms 222 at second pivot points 224. The rear plate 212 connects at braces 302 to the second pair of arms 222 at third pivot points 226 and the first pair of arms 216 at fourth pivot points 214. The first pair of arms 216 is shorter than and non-parallel to the second pair of arms 222. Pins forming the various pivot points or axes are bolts and nuts or other appropriate fasteners (not shown).

Figure 13B:
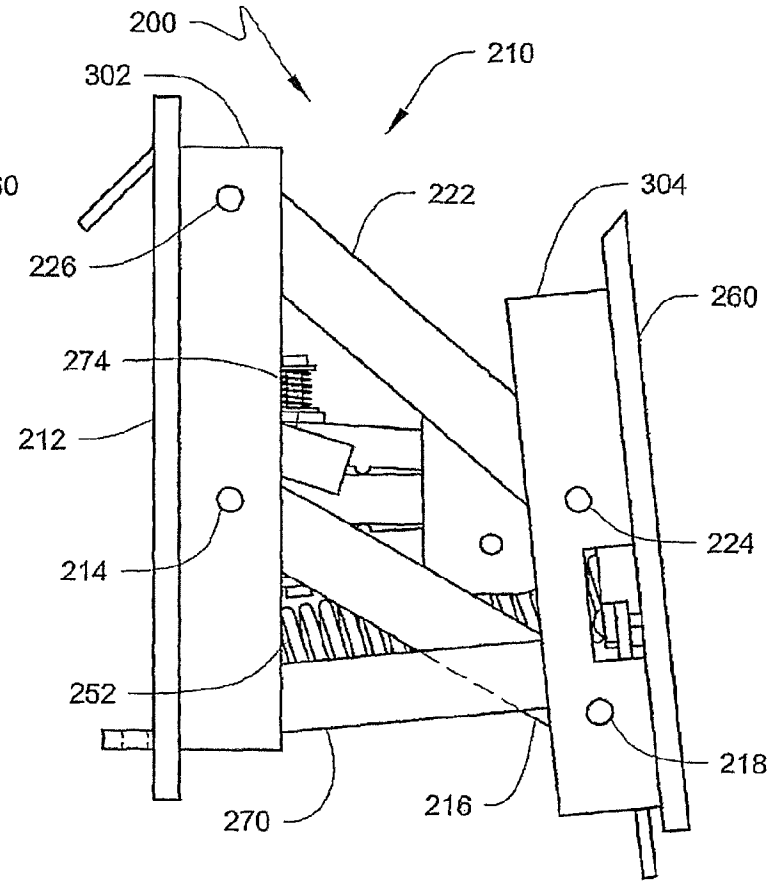
FIG. 13B is an enlarged side view of the quadrilateral linkage of FIG. 12B, when the quadrilateral linkage is activated.
Figure 13A:
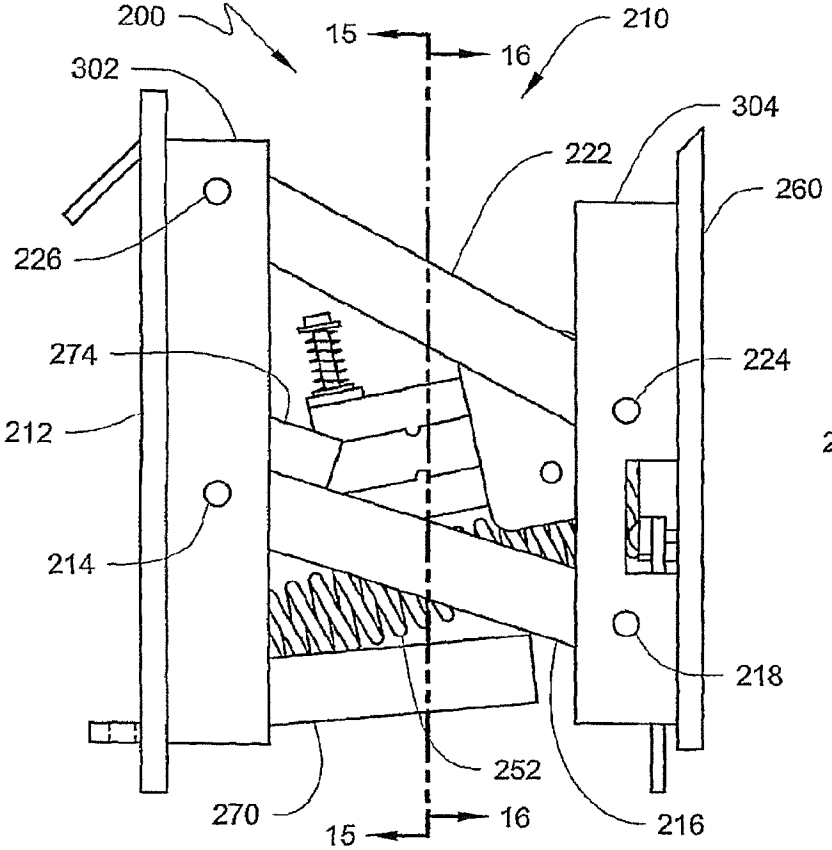
FIG. 13A is an enlarged side view of the quadrilateral linkage of FIG. 12 A, when the quadrilateral linkage is not activated.
Figure 14:
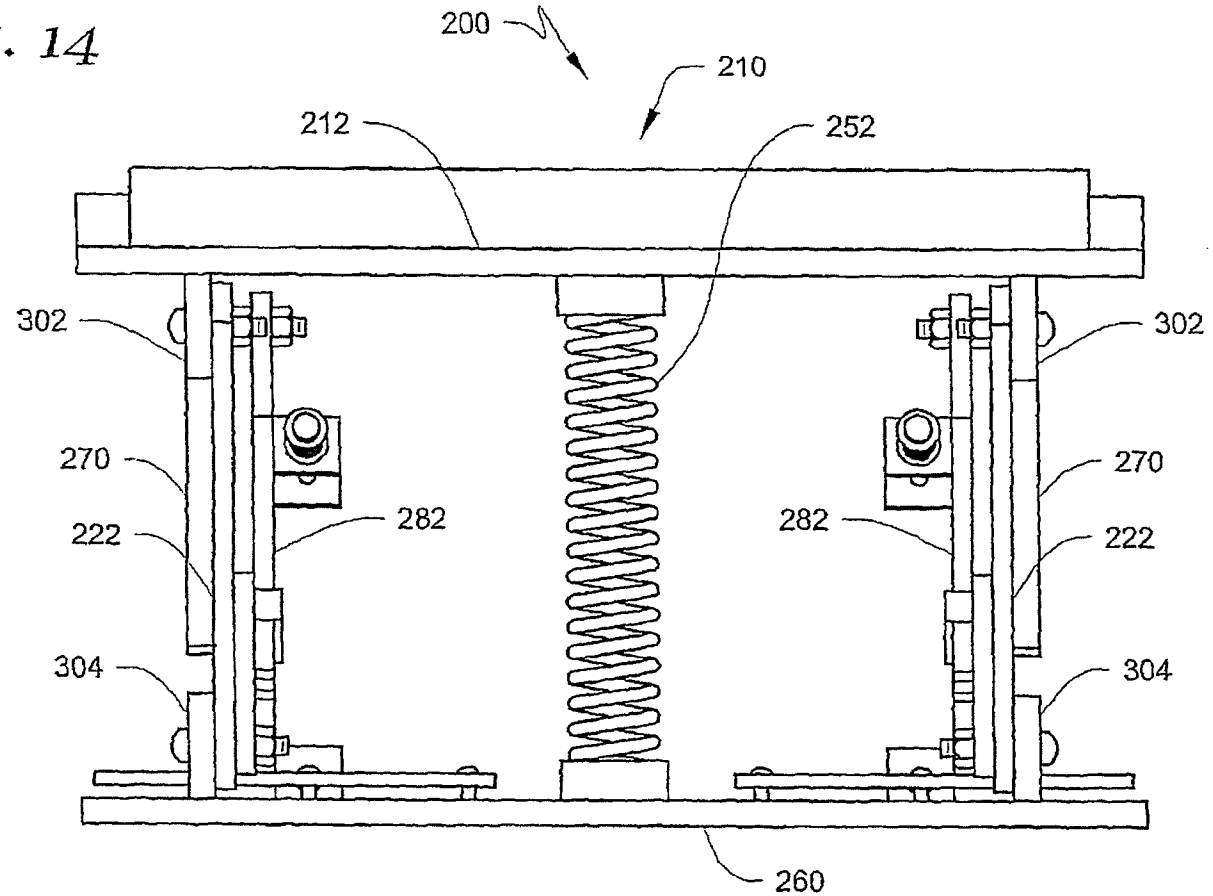
FIG. 14 is a top view of the quadrilateral linkage.
Figure 15:
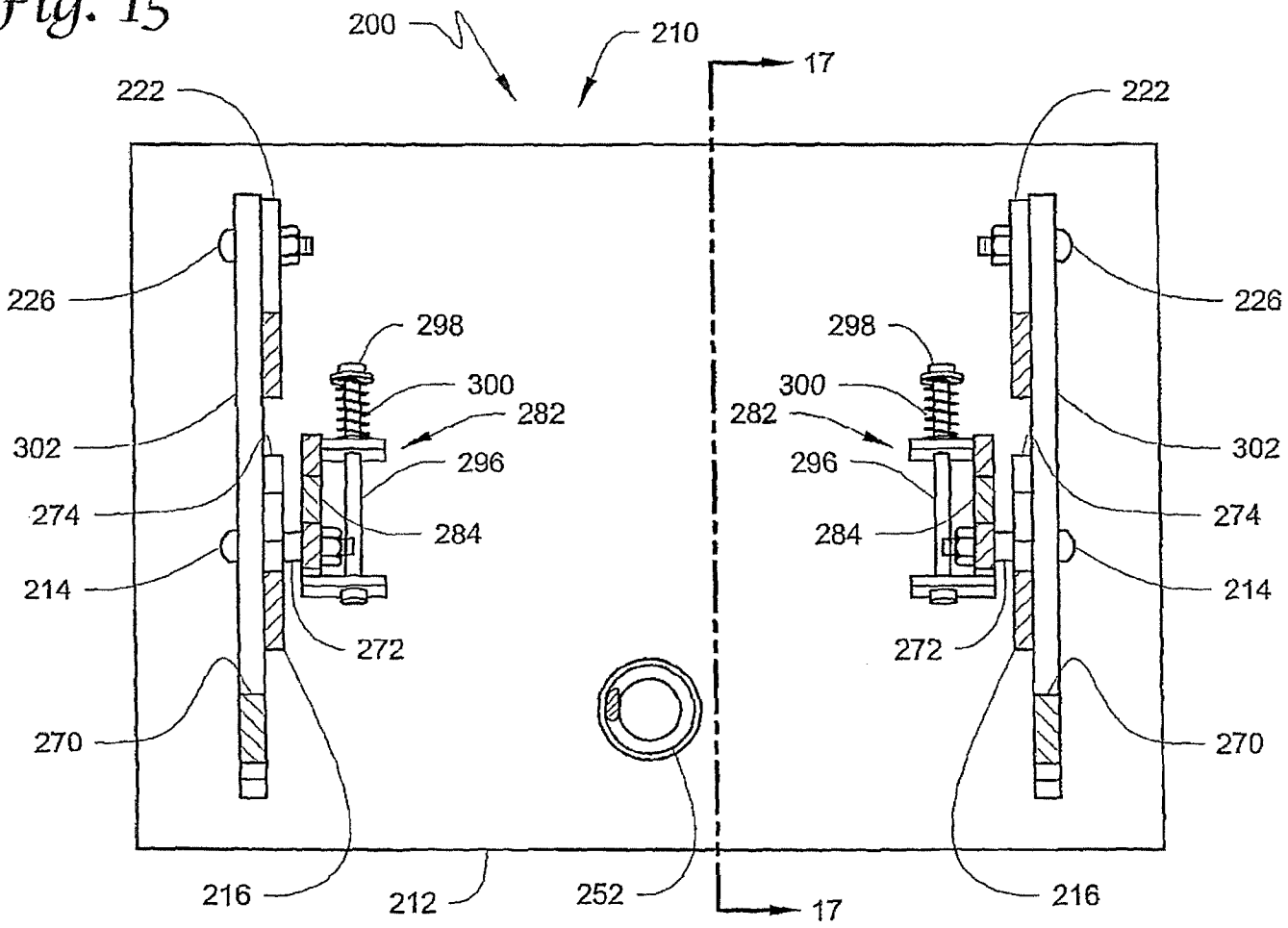
FIG. 15 is a sectional view of the quadrilateral linkage as shown in FIG. 13A, taken along section line 15-15, showing the rear plate.
Figure 16:
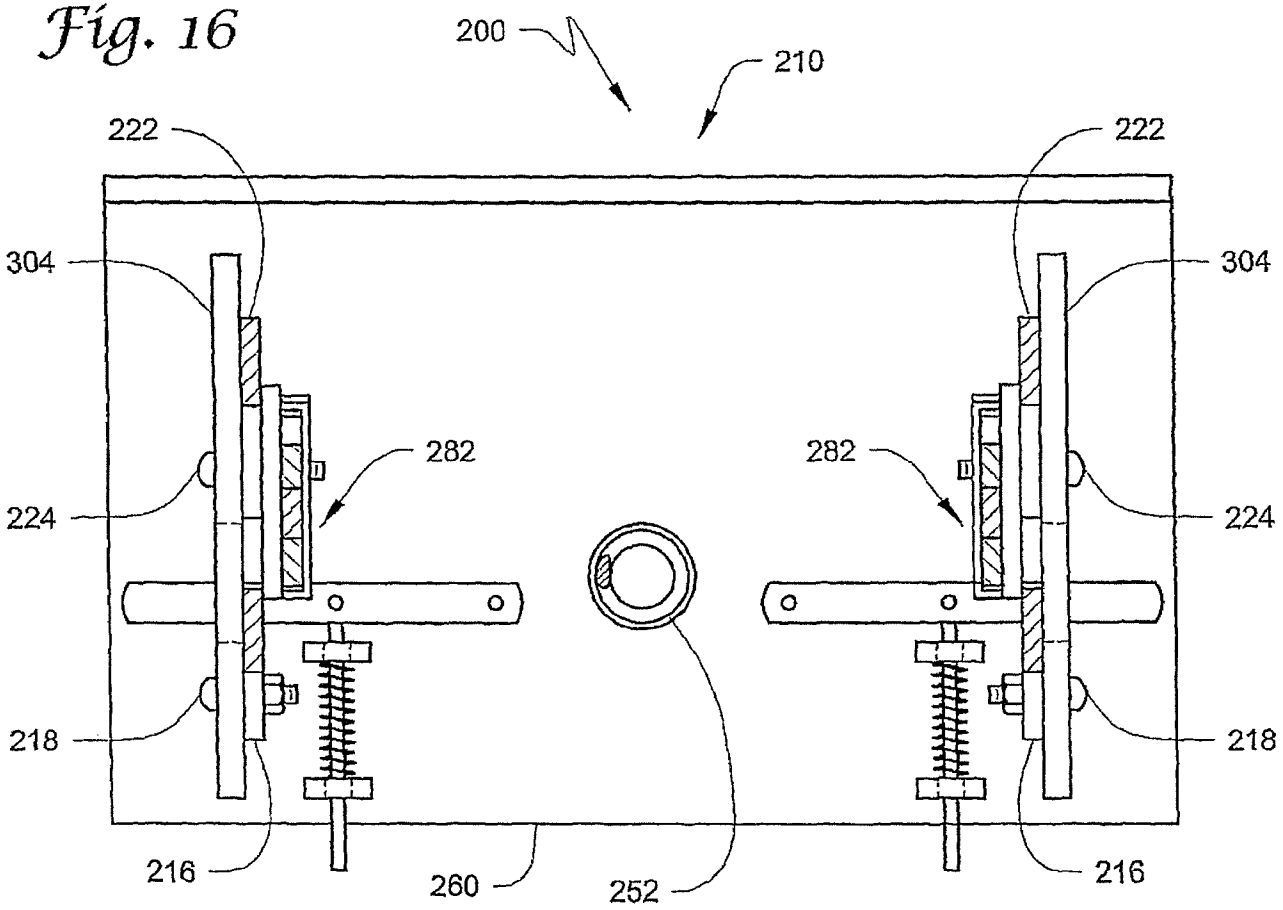
FIG. 16 is a sectional view of the quadrilateral linkage as shown in FIG. 13A, taken along section line 16-16, showing the front plate.

The linkage assembly 200 has an inactivated state or first configuration as shown in FIG. 13A and an activated state or second configuration as shown in 13B. In the inactivated state, the linkage assembly 200 is urged to its designed limit by a bias member, such as a spring 252. The linkage assembly 200 is activated when a scraping edge 266 of the bucket 220 strikes an immovable object 234. During this process, the spring 252 is compressed and the quadrilateral linkage 210 is likewise compressed. The first pivot axis 218 moves in the direction of the bucket 220 relative to the second pivot axis 224 so that the bucket 220 is tilted at its heel 268 and the scraping edge 266 is elevated and rides up and over the immovable object 234.

The linkage assembly 200 may also include a first stopper device 270 to prevent over compression in the activated state and a second stopper device 274 to determine the design limit of the inactivated state. Stopper device 270 is attached to a brace 302 and extends forwardly toward plate 260 and when there is a hard impact stopper device 270 contacts plate 260 and solidifies linkage assembly 200. There could be more than one stopper device 270. Stopper device 274 is located to contact one of the front and rear plates 260,212 and one of the first and second pair of arms 216,222 when linkage assembly 200 is in the inactivated state. Likewise, there could be more than one stopper device 274. The linkage assembly 200 may also include a mechanical nipple and détente assembly 282. As similarly described with respect to an earlier embodiment, the nipple and détente assembly 282 includes a détente member 284 pivotally attached to the rear plate 212 at pivot point 272 (shown attached to rear plate 212 at brace 302) and a nipple sub-assembly 306 pivotally attached to the front plate 260 at a pivot point 286 (shown attached to front plate 260 at brace 304). It will be appreciated that the nipple and détente assembly 282 can be attached anywhere between the front and rear plates 260 and 212 in any appropriate position, for example, attaching the détente member 284 to the front plates 260 and attaching the nipple sub-assembly 306 to the rear plate 212. The nipple sub-assembly 306 includes a pair of plates 308, on either side of détente member 284, which are held together at one end with a bolt 296 and nut 298. A bracket 310 is pivotally attached at the pivot point 286 and plates 308 are pivotally attached to bracket 310 at the other end of plates 308. A coil spring 300 is provided on bolt 296 between nut 298 and one of plates 308. The combination of nut and bolt 298, 296 and spring 300 provides a force adjustment for nipple/détente assembly 282. That is, if nut 298 is tightened against spring 300, it takes more force to separate plates 308 and allow détente member to pull away and further allow the quadrilateral linkage 210 to activate. Protuberance nipples 312 are provided on each of the plates 308, while indention détentes 314 are located to receive nipples 312 when linkage 210 is inactivated. The nipple and détente assembly 282 provides an extra retention mechanism in addition to the elastomeric force provided by the spring 252 for any impact force to overcome caused by the scraping edge striking an immovable object.

In use, the loader vehicle operator operates the hook 262 to scoop the rear plate 212 of the quadrilateral linkage 210 and then uses the front plate 260 of the linkage 210 to scoop the bucket 220. In the inactivated state, the linkage 210 is urged to its designed limit by the spring 252 against stopper device 274. The linkage 210 is activated when the scraping edge 266 of the bucket 220 strikes an immovable object 234. During this process, the spring 252 is compressed and the quadrilateral linkage 210 is likewise compressed. The first pivot axis 216 moves in the direction of the bucket 220 relative to the second pivot axis 224 so that the bucket 220 is tilted at its heel 268 and the scraping edge 266 is elevated and rides up and over the immovable object 234. In the case of a heavy impact, plate 260 may contact stopper device 270.

Figure 17B:
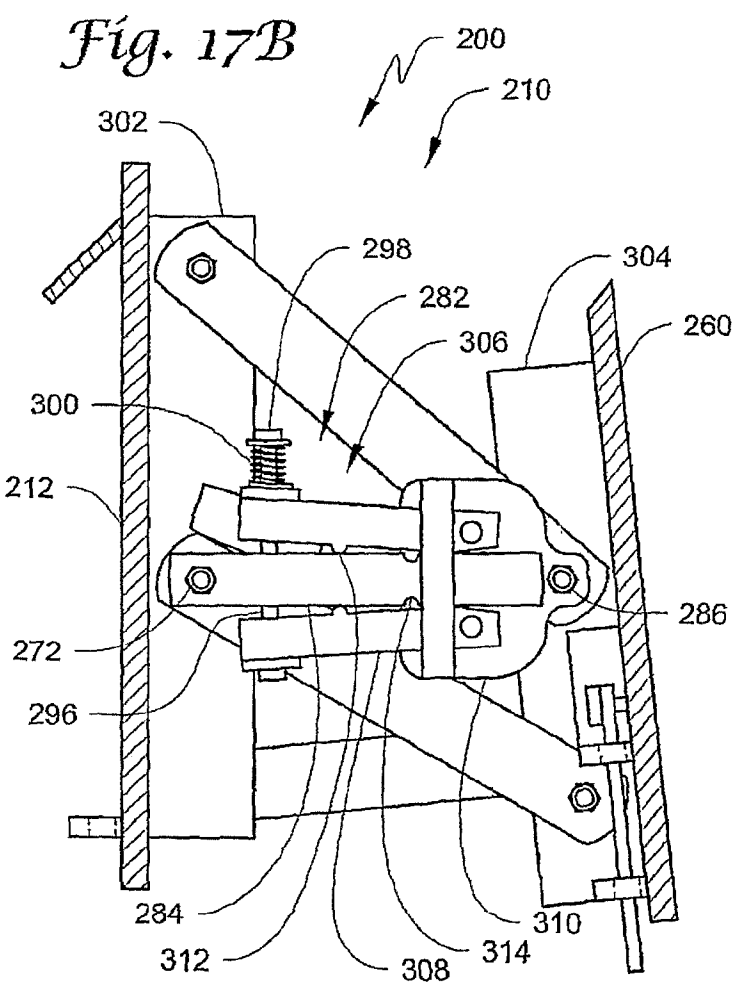
FIG. 17B is a side sectional view of the quadrilateral linkage including the nipple and détente assembly, when the quadrilateral linkage is activated.
Figure 17A:
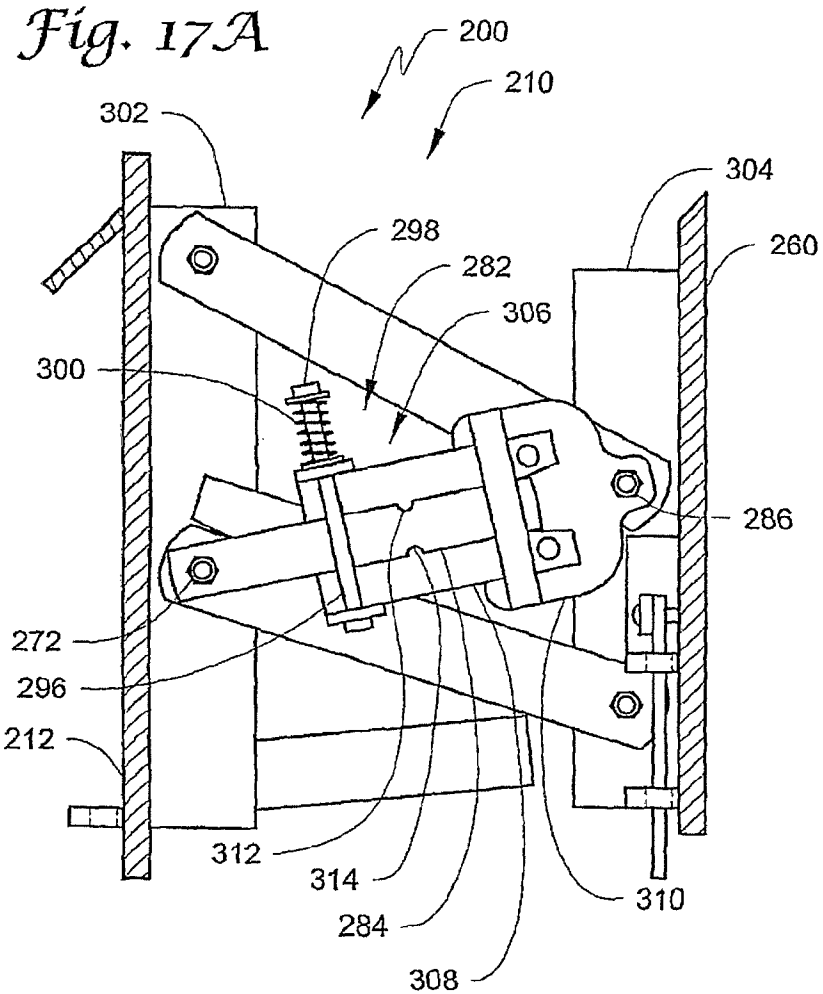
FIG. 17A is a side sectional view of the quadrilateral linkage including a nipple and détente assembly, as shown in FIG. 15, taken along section line 17-17, when the quadrilateral linkage is not activated.

In an embodiment where a nipple/détente assembly 282 appears, when an immovable object 234 is struck and a force is generated above the preset threshold force, the détente member 284 overcomes the force of the spring 300 thereby releasing détente member 284 which allows the front plate 260 to be compressed toward the rear plate 212 as depicted in FIG. 17B. Once linkage 210 is urged back to the inactivated state, the nipple and détente assembly 282 resets as in FIG. 17A.

Figure 18A:
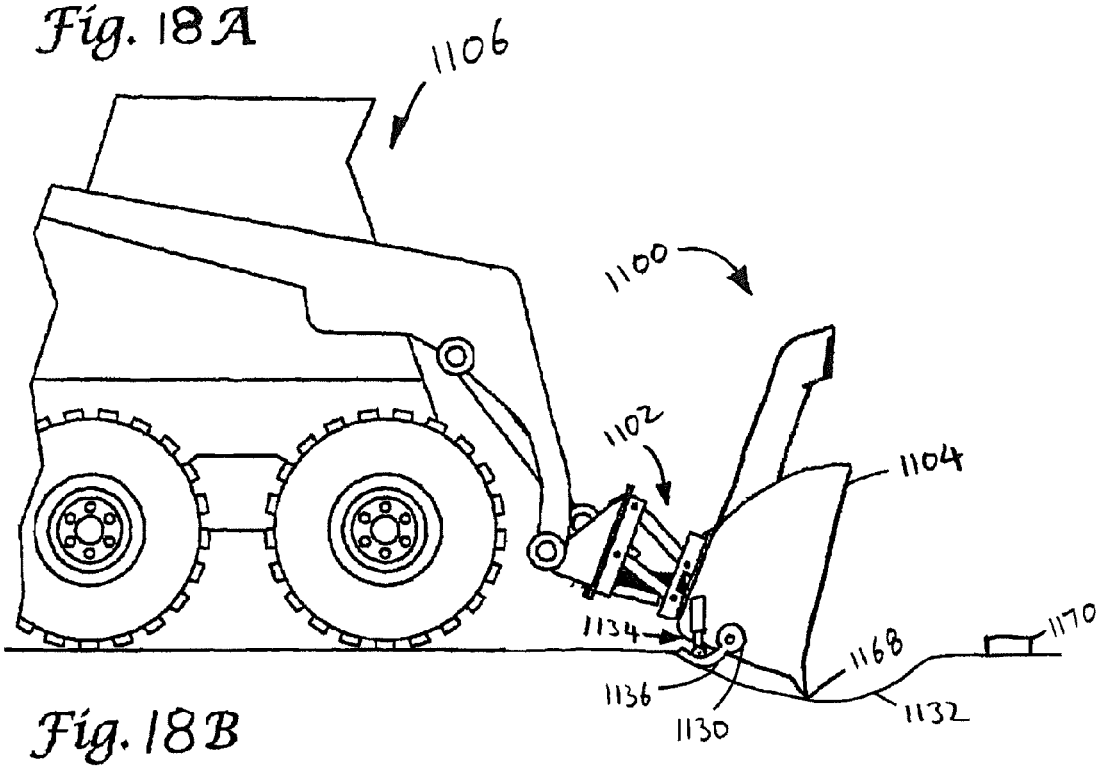
FIG. 18A is a side view of an embodiment showing a vehicle with a quadrilateral linkage connecting a work assembly to the vehicle, when the quadrilateral linkage is not activated and the dynamic skid shoe is in a dynamic state.
Figure 18B:
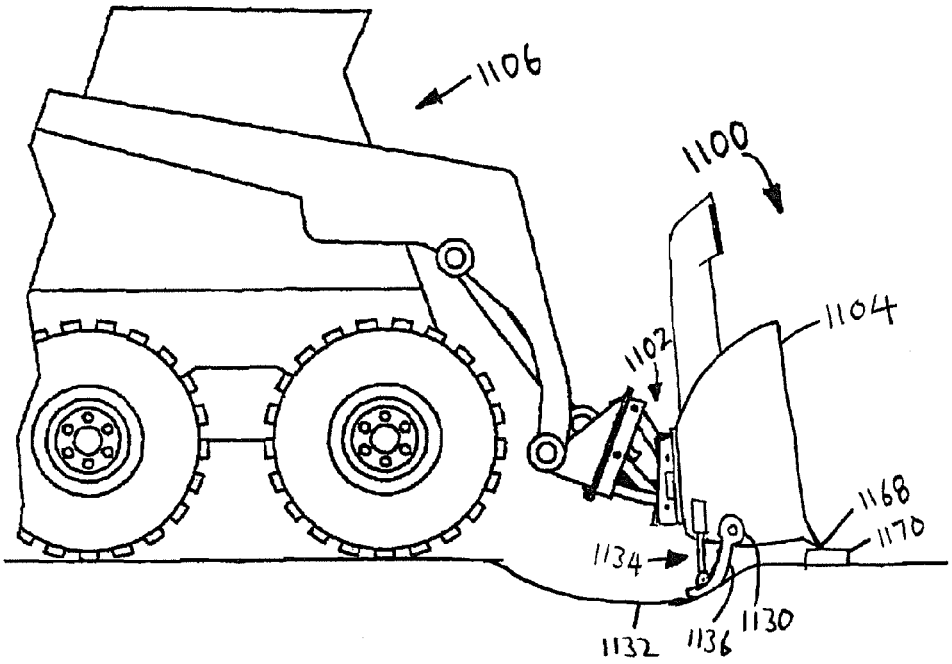
FIG. 18B is a side view of an embodiment showing a vehicle with a quadrilateral linkage connecting a work assembly to the vehicle, when the quadrilateral linkage is activated and the dynamic skid shoe is in a rigid state.

In FIGS. 18A, 18B, 19A, 19B, and 20, like reference numerals designate identical or corresponding parts throughout the several views. FIGS. 18A, 18B, 19A, 19B, and 20 show portions of an embodiment of an implement 1100 that include a quadrilateral linkage 1102 and connect a work assembly 1104 and a vehicle 1106. FIGS. 18A and 18B show the work assembly 1104 to be a snow blower for clearing snow.

The implement 1100 includes a front plate 1108 that connects conventionally to the work assembly 1104, shown to be a snow blower for plowing snow as an example, of the vehicle 1106 and a rear plate 1110 that connects conventionally to the vehicle 1106. With respect to the quadrilateral linkage 1102, the front plate 1108 connects at a brace 1112 to a first pair of arms 1114 at first pivot points 1116 and to a second pair of arms 1118 at second pivot points 1120. The rear plate 1110 connects at another brace 1122 to the second pair of arms 1118 at third pivot points 1124 and the first pair of arms 1114 at fourth pivot points 1126. The first pair of arms 1114 is shorter than and non-parallel to the second pair of arms 1118. Pins forming the various pivot points or axes are bolts and nuts or other appropriate fasteners (not shown).

Figure 19B:
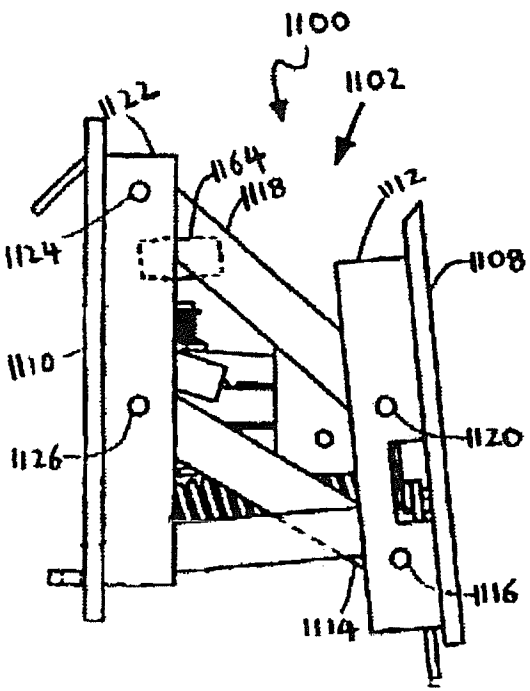
FIG. 19B is an enlarged side view of an embodiment of the quadrilateral linkage of FIG. 18B, when the quadrilateral linkage is activated and the trigger mechanism is triggered.
Figure 19A:
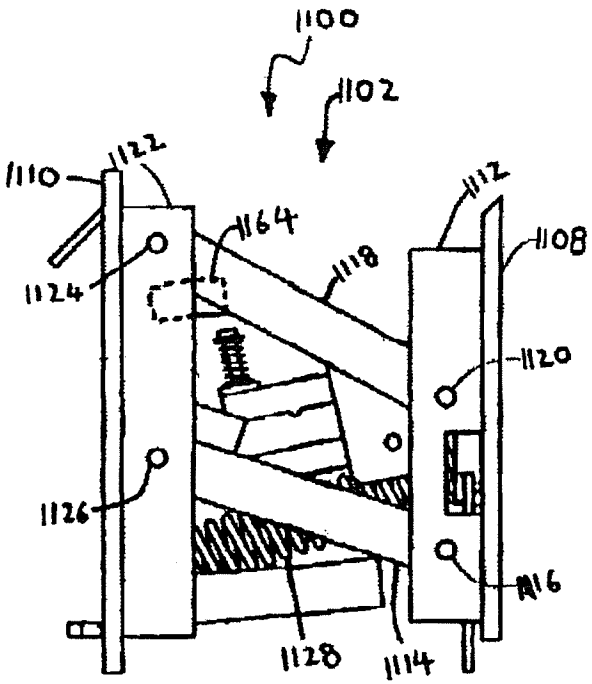
FIG. 19A is an enlarged side view of an embodiment of the quadrilateral linkage of FIG. 18A, when the quadrilateral linkage is not activated and the trigger mechanism is not triggered.

The implement 1100 has an inactivated state or first configuration as shown in FIG. 19A and an activated state or second configuration as shown in 19B. In the inactivated state, the implement 1100 is urged to its designed limit by a bias member, such as a spring 1128 or alternatively an air bag (not shown). Further, in an inactivated state, rear portion of the work assembly 1104 does not move downward to contact the surface of the dip 1132 because a dynamic skid shoe 1134 extends to meet the surface in the dip 1132. The dynamic skid shoe 1134 that contacts the surface bears a significant portion of the weight of the work assembly 1104.

More particularly, the dynamic skid shoe 1134 includes a surface contact component 1136 (see also FIGS. 20 and 21) for contacting a surface of a street. The surface contact component 1136 is hingedly connected to a leg 1138 at a hinge 1139. The surface contact component 1136 is also hingedly connected to the work assembly 1104 at a frame hinge 1130, such that as the leg 1138 extends or compresses, the surface contact component 1136 pivots about the frame hinge 1130. Also, as the leg 1138 extends or compresses, the surface contact component 1136 has a point of rotation about the hinge 1139. The leg 1138 includes a top portion 1140 and a bottom portion 1142. The top portion 1140 is slidably connected to the bottom portion 1142, the bottom portion 1142 being connected to a rigid leg member 1144 that is connected to the surface contact component 1136. A hydraulic cylinder 1146 is attached to the top portion 1140 at a top hydraulic cylinder coupling 1148, and to the bottom portion 1142 at a bottom hydraulic cylinder coupling 1150. The hydraulic cylinder 1146 contains a hydraulic cylinder piston 1152 and a hydraulic cylinder rod 1154. An upper cavity 1156 is located in the hydraulic cylinder 1146 above the piston 1152, and a lower cavity 1158 is located below the piston 1152. A hydraulic fluid circuit 1160 is fluidily connected to the hydraulic cylinder 1146. The hydraulic cylinder 1146 may be a one-way hydraulic cylinder. The hydraulic fluid circuit 1160 may be fluidily connected to the upper cavity 1156. The hydraulic fluid circuit 1160 may not be fluidily connected to the lower cavity 1158. The hydraulic fluid circuit 1160 includes a gate valve 1162 which is controlled by a sensor which senses when an impact of predetermined force occurs. Example of the sensor is a trigger mechanism 1164 provided at the linkage 1102. The hydraulic fluid circuit 1160 includes a fast-acting gas-filled hydraulic accumulator 1166 that is fluidily connected to the hydraulic cylinder 1146. The hydraulic cylinder

1146 is configured to apply constant pressure to the dynamic skid shoe 1134 via the fluid pressure from the hydraulic accumulator 1166 through the hydraulic fluid circuit 1160. Because the dynamic skid shoe 1134 bears the total or a portion of the weight of the work assembly 1104, the pressure provided by the fluid circuit 1160 is countered by the force of the weight supported by the skid shoe 1134.

FIGS. 18A, 18B, 19A, and 19B are side views, thus the opposite sides of side views are not shown. It will be understood that, via symmetry, the opposite sides of the respective views are substantially, if not exactly, the mirror image version of the side views shown in FIGS. 18A, 18B, 19A, and 19B. Accordingly, although only one dynamic skid shoe 1134 is shown in FIG. 18A, it will be understood that the work assembly 1104 has at least two dynamic skid shoes 1134 supporting the significant portion of the weight of the work assembly 1104, the scraping blade preferably supporting some weight.

In operation, when the trigger mechanism 1164 has not been triggered and the gate valve 1162 is in an open state such that fluid connection between the hydraulic cylinder 1146 and the hydraulic accumulator 1166 is allowed, the hydraulic cylinder 1146 extends or compresses to slidably move the upper portion 1142 and the bottom portion 1142 relative to each other. This sliding movement extends or compresses the leg 1138 and the surface contact component 1136 as the surface contact component 1136 moves along the surface of the ground. On uneven surfaces, the surface contact component 1136 follows the surface characteristics with the leg 1138 extending or compressing, such that where there is a dip 1132 in the surface, the dynamic skid shoe 1134 extends to keep the surface contact component 1136 to be in contact with the surface. As a comparison to the embodiment shown in FIGS. 12A and 12B, the surface contact component 1136 of the dynamic skid shoe 1134 acts as and has the same function of the heel 268 with respect to elevating the respective edges 1168, 266. Unlike the heel 268, the dynamic skid shoe 1134 can perform its function at uneven surface conditions, such as the dip 1132 in the ground.

When an edge 1168 of the work assembly 1104 strikes an obstruction 1170, the implement 1100 is activated. During this process, the spring 1128 is compressed and the quadrilateral linkage 1102 is likewise compressed. Since the linkage 1102 can only compress so far, the presence of the inventive dynamic skid shoe 1134 can be important. The compression of the quadrilateral linkage 1102 triggers the sensor such as the trigger mechanism 1164 provided at the quadrilateral linkage 1102. The trigger mechanism 1164 may be mechanical or powered by a power source 1172. The trigger mechanism 1164 is configured to send a signal to the gate valve 1162 of the hydraulic fluid circuit 1160 to change the state of the gate valve 1162 to a closed state. When the gate valve 1162 is in a closed state, the fluid flow between the hydraulic cylinder 1146 and the hydraulic accumulator 1166 is stopped, and the hydraulic cylinder 1146 becomes a rigid structure.

Thus, the dynamic skid shoe 1134 is locked into a rigid state from a dynamic state via a trigger mechanism 1164 that is triggered when the quadrilateral linkage 1102 is compressed upon the edge 1168 of the work assembly 1104 striking an obstruction 1170. Due to the compression of the quadrilateral linkage 1102, the first pivot axis formed by the first pivot points 1116 moves in the direction of the work assembly 1104 relative to the second pivot axis formed by the second pivot points 1120 so that the work assembly 1104 is tilted at the dynamic skid shoe 1134 and the edge 1168 is elevated and rides up and over the obstruction 1170. The work assembly 1104 is able to be tilted at the dynamic skid shoe 1134 even though there is a dip 1132 below the rear portion because the dynamic skid shoe 1134 is extended to meet the surface in the dip 1132 and is locked into a rigid state to bear the weight of the work assembly 1104 as the edge 1168 is elevated.

Once the work assembly 1104 clears the obstruction 1170, the linkage 1102 returns to the first state and causes the trigger mechanism 1164 to switch to a non-triggered state, and the gate valve 1162 is opened. At the non-triggered state, the trigger mechanism 1164 can be configured to send another signal to the gate valve 1162 to open the gate valve 1162, or the trigger mechanism 1164 can be configured to stop sending a signal to the gate valve 1162 to open the gate valve 1162. The opened gate valve 1162 allows the hydraulic fluid flow between the hydraulic accumulator 1166 and the hydraulic cylinder 1146. The dynamic skid shoe 1134 returns to a dynamic state wherein the dynamic skid shoe 1134 can once again extend or compress according to the surface characteristics of the ground.

Figure 20:
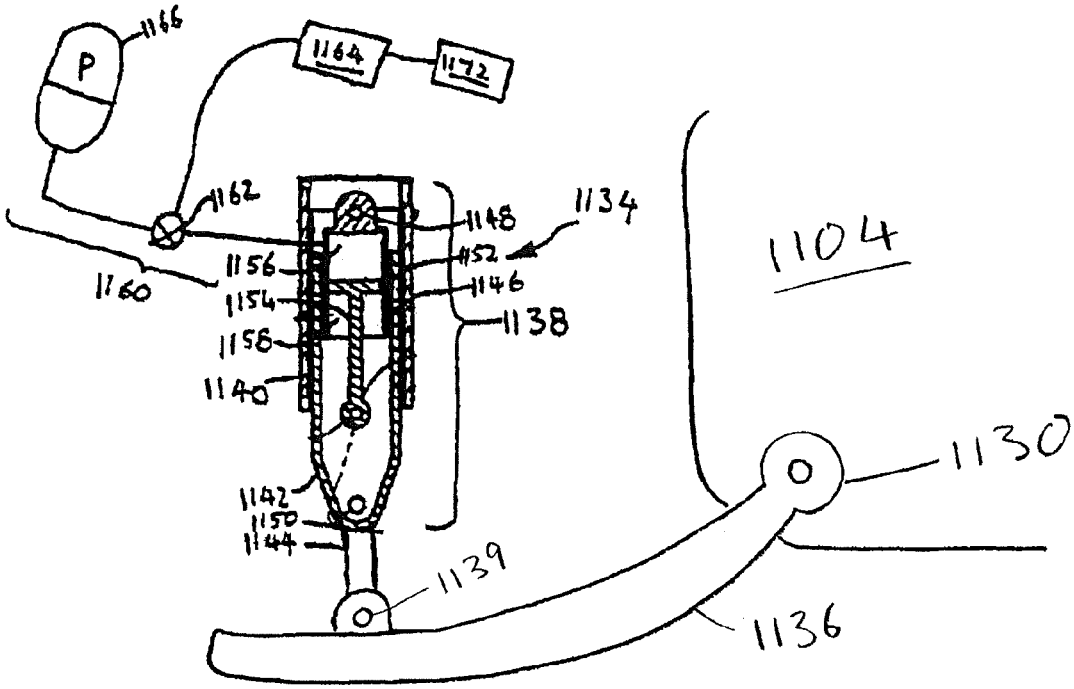
FIG. 20 is a diagram of an embodiment of the dynamic skid shoe and a hydraulic fluid circuit.
Figure 21:
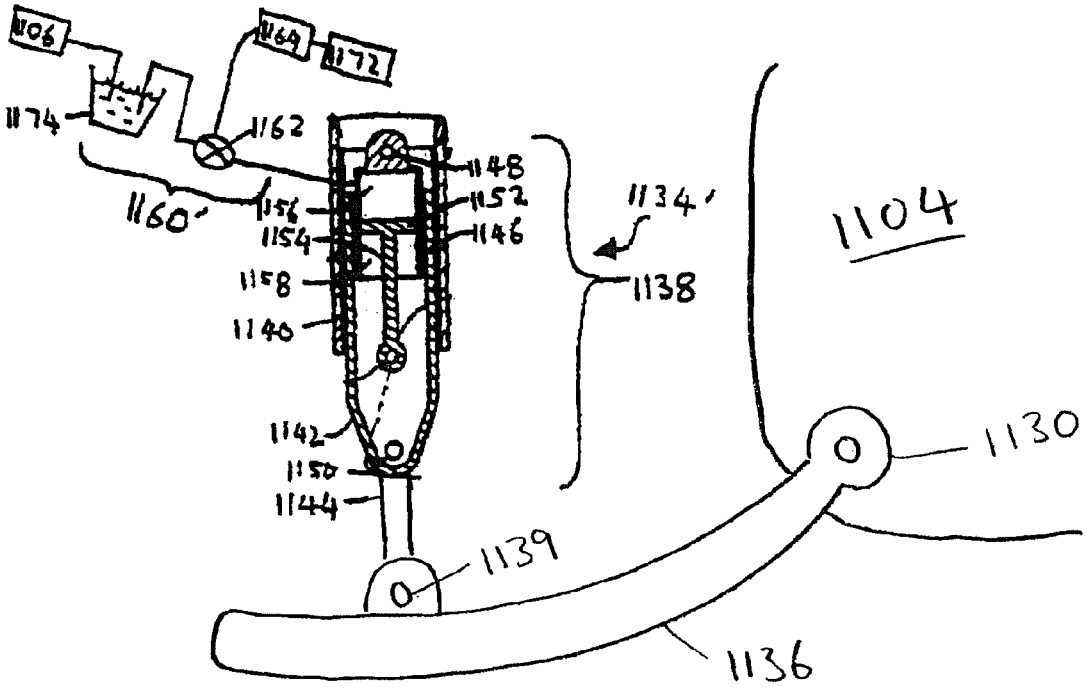
FIG. 21 is a diagram of an embodiment of the dynamic skid shoe and a hydraulic fluid circuit.

FIG. 21 shows another embodiment of a dynamic skid shoe 1134' and fluid circuit 1160' that does not have the hydraulic accumulator 1166 shown in FIG. 20. Like reference numerals in FIG. 21 designate identical or corresponding parts shown in FIG. 20. As an alternative to the hydraulic accumulator 1166, the hydraulic fluid circuit 1160' is configured to provide a pressure needed for the operation of the dynamic skid shoe 1134' by configuring a reservoir 1174 to receive the pressure from a forward movement of the vehicle 1106 and fluidily transmit the pressure to the hydraulic cylinder 1146.

Figure 22:
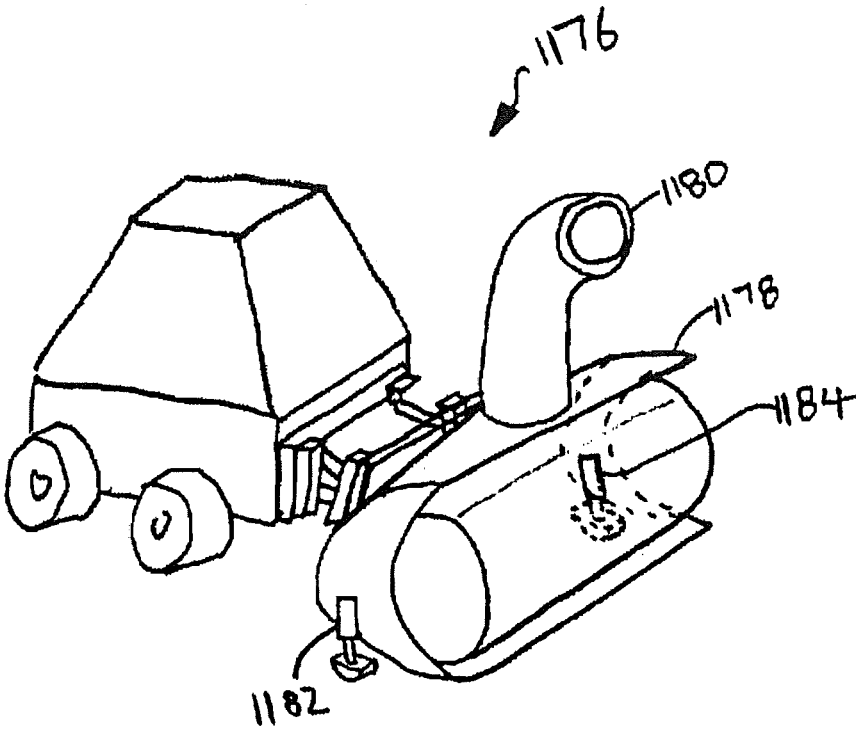
FIG. 22 is a side view of an embodiment of a snow blower vehicle.

FIG. 22 shows an embodiment of a snow blower vehicle 1176. The snow blower vehicle 1176 includes an snow blower 1178 and a chute 1180, with a pair of dynamic skid shoes 1182, 1184 provided at opposing sides of the snow blower 1178 in a width direction. The chute 1180 may not be disposed exactly at the center in the width direction of the snow blower 1178. In this configuration, the center of mass, widthwise, is not at the middle of the snow blower 1178. Thus the forces from the weight of the snow blower 1178 supported by each of the skid shoes 1182, 1184 are not equal. In other words, one of the skid shoes 1182, 1184 is supporting a greater portion of the snow blower's 1178 weight than the other skid shoe 1182, 1184. To address this uneven distribution of the snow blower's 1178 weight, each of the skid shoes 1182, 1184 may be configured for supporting the uneven distribution of the weight of the snow blower 1178. Thus, the dynamic skid shoes 1182, 1184 may each have different hydraulic cylinder diameters. The different diameter sizes being selected for the uneven distribution of the snow blower's 1178 weight. For example, one of the hydraulic cylinders may have a $1\frac{13}{16}$ inch diameter, and the other hydraulic cylinder may have a $1\frac{1}{8}$ inch diameter.

Alternatively, each of the dynamic skid shoes 1182, 1184 may be independently connected to a pressure providing device, and each of the pressure providing device may be independently set to different pressure levels. Thus, the dynamic skid shoes 1182, 1184 may have the same hydraulic cylinder diameters.

Figure 23:
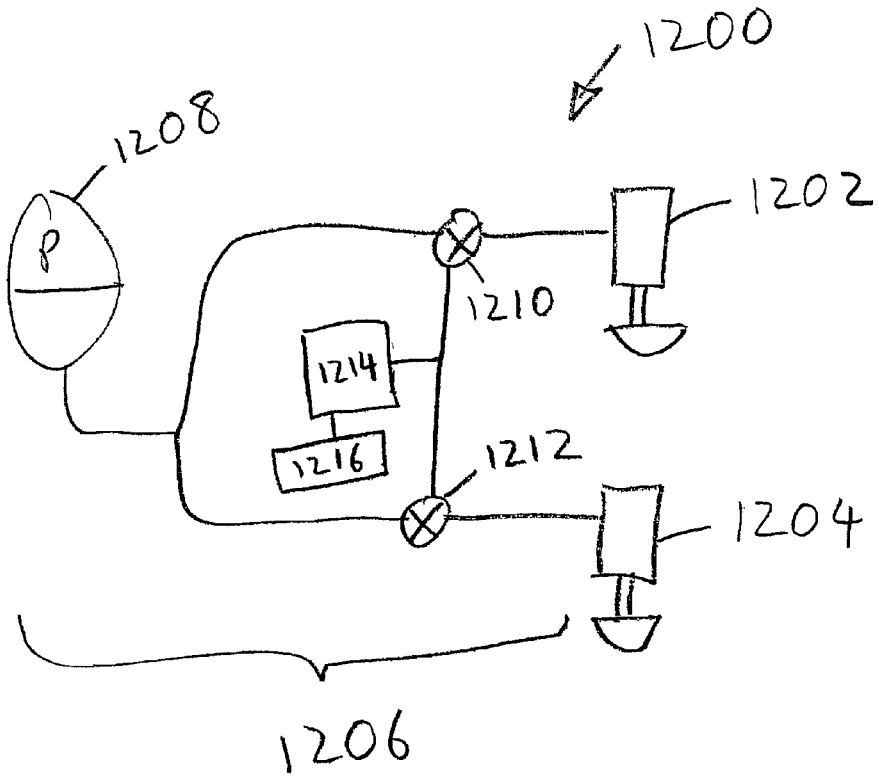
FIG. 23 is a diagram of another embodiment having a pair of dynamic skid shoes connected to a hydraulic fluid circuit.

FIG. 23 shows an embodiment of a dynamic skid shoe system 1200 for the embodiments of implements and/or a snow clearing device. The system 1200 includes first and second dynamic skid shoes 1202, 1204, each dynamic skid shoe 1202, 1204 being identical or similar to the dynamic skid shoe 1134 shown in FIG. 20. The first and second dynamic skid shoes 1202, 1204 are fluidily connected to a fluid circuit 1206. The fluid circuit 1206 fluidily connecting both dynamic skid shoes 1202, 1204 to a hydraulic reservoir 1208. The fluid circuit 1206 includes a first gate valve 1210 that controls fluid travel between the first dynamic skid shoe 1202 and the hydraulic reservoir 1208, and a second gate valve 1212 that controls fluid travel between the second dynamic skid shoe 1204 and the hydraulic reservoir 1208. When both gate valves 1210, 1212 are closed, hydraulic fluid travel between first dynamic skid shoe 1202 and the hydraulic reservoir 1208 is stopped, hydraulic fluid travel between second dynamic skid shoe 1204 and the hydraulic reservoir 1208 is stopped, and hydraulic fluid travel between first dynamic skid shoe 1202 and the second dynamic skid shoe 1204 is stopped. The fluid circuit 1206 is connected to a sensor 1214 that controls the closing or opening of the gate valves 1210, 1212. A power source 1216 supplies the required power to the sensor 1214 for its operation. It is understood that in another embodiment, the hydraulic accumulator 1208 is replaced by a reservoir configured to provide pressure from a forward movement of the vehicle, similar to the fluid circuit 1160' shown in FIG. 21.

It will be understood that the linkage 1102 may be replaced by any of the embodiments of linkages and/or hinged joints shown in FIGS. 1A to 11B. Alternatively, the work assembly 1100 including a snow blower 1104 and dynamic skid shoes 1134 can replace the bucket 20 shown in FIGS. 1A to 11B.

A preferred embodiment has been described for illustrative purposes. Those skilled in the art will appreciate that various modifications and substitutions are possible without departing from the scope of the invention, including the full scope of equivalents thereof.

What is claimed is:

1. An implement attaching to a vehicle, comprising:

a linkage assembly; and a work assembly with an edge, said work assembly also including a dynamic skid shoe, said dynamic skid shoe including:

a surface contact component for contacting a street surface, a dynamic component operably connected to the surface contact component for providing vertical movement of the surface contact component, and a hydraulic fluid circuit including a pressure providing component fluidily connected to the dynamic component, wherein said linkage assembly is attachable as an attachment between the work assembly and the vehicle, the linkage assembly having first and second configurations, the first configuration providing the edge to scrape along a path following with prevailing ground surface, the second configuration providing the edge to be elevated above the prevailing ground surface in order to pass over an obstruction encountered by the edge as the edge moves in a forward direction, the edge moving about the dynamic skid shoe as the linkage assembly goes from the first configuration to the second configuration.

2. The implement according to claim 1, said hydraulic fluid circuit including a gate valve; and said linkage assembly including a sensor that senses a transition of the linkage assembly switching from the first configuration to the second configuration, wherein when the sensor senses the transition of the linkage assembly switching from the first configuration to the second configuration, the sensor communicates to the gate valve to close a hydraulic fluid travel between the pressure providing component and the dynamic component, and wherein when the sensor senses the transition of the linkage assembly switching from the second configuration to the first configuration, the sensor communicates to the gate valve to open the hydraulic fluid travel between the pressure providing component and the dynamic component.

3. The implement according to claim 2, wherein when said linkage assembly is in the second configuration, the dynamic component is in a rigid state due to closing of the gate valve, the surface contact component is on the ground, and the edge is elevated to allow the edge to ride over the obstruction.

4. The implement according to claim 1, wherein when the edge of the work assembly strikes the obstruction, the linkage assembly moves from the first to the second configuration, wherein when the linkage assembly is in the first configuration, the surface contact component is on the ground, the dynamic component is in a dynamic state; and wherein when the linkage assembly is in the second configuration, the surface contact component is on the ground, the dynamic component is in a rigid state, and the edge is elevated to allow the edge to ride over the obstruction.

5. The implement according to claim 1, further comprising:

a control component that controls the pressure of the pressure providing component to and/or from the dynamic component.

6. The implement according to claim 1, wherein the dynamic component includes a one-way hydraulic cylinder.

7. The implement according to claim 1, wherein the pressure providing component includes a hydraulic accumulator.

8. The implement according to claim 1, wherein the pressure providing component is configured to provide a set pressure by a forward movement of the vehicle.

9. The implement according to claim 1, wherein the fluid circuit includes a gate valve having an open state and a closed state, the gate valve controlling a pressure connection between the pressure providing component and the dynamic component, wherein when the gate valve is in the open state, the pressure connection between the pressure providing component and the dynamic component is allowed, and when the gate valve is in the closed state, the pressure connection between the pressure providing component and the dynamic component is not allowed.

10. The implement according to claim 1, wherein the work assembly includes a snow blower.

* * * * *